US011974621B2

(12) United States Patent
Hansen et al.

(10) Patent No.: US 11,974,621 B2
(45) **Date of Patent: *May 7, 2024**

(54) FALSE EYELASH APPARATUS AND METHODS

(71) Applicant: Hal J Hansen, Toms River, NJ (US)

(72) Inventors: Hal J Hansen, New Jersey, NJ (US); Alyssa B Jackson, Philadelphia, PA (US)

(73) Assignee: Hal J. Hansen, Toms River, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/341,298

(22) Filed: Jun. 7, 2021

(65) Prior Publication Data

US 2021/0289869 A1 Sep. 23, 2021

Related U.S. Application Data

(63) Continuation of application No. 15/215,571, filed on Jul. 20, 2016, now Pat. No. 11,051,570, which is a (Continued)

(51) Int. Cl.
*A41G 5/02* (2006.01)

(52) U.S. Cl.
CPC ..... *A41G 5/02* (2013.01)

(58) Field of Classification Search
CPC ..... A41G 5/02; A41G 5/0086; A45D 2/48; A45D 26/0066; A45D 2200/25
See application file for complete search history.

(56) References Cited

U.S. PATENT DOCUMENTS

D83,872 S 4/1931 McDonell
1,939,013 A 12/1933 Lewis
(Continued)

FOREIGN PATENT DOCUMENTS

CA 2936859 A1 7/2015
EP 3094198 B1 11/2016
(Continued)

OTHER PUBLICATIONS

BR Patent Application No. BR 11 2016 016477 6 filed Jul. 15, 2016, entitled False Eyelash Apparatus and Methods by Hal J Hansen.
(Continued)

*Primary Examiner* — Rachel R Steitz
(74) *Attorney, Agent, or Firm* — Franklin & Associates International Inc; Matthew F. Lambrinos

(57) ABSTRACT

False eyelash apparatus and methods for applying false eyelashes. A false eyelash holder for holding a false eyelash has a support member for supporting the false eyelash and is adjustable to cause inversion of the false eyelash from a convex shape to a substantially concave shape. An inverter-loader device is configured to receive the holder and operable to adjust the holder to cause the false eyelash inversion. An applicator for applying an inverted false eyelash to an eyelid may have a unitary structure or may be a clamp for gripping the inverted false eyelashes. The applicator is operable to carry the inverted false eyelash for allowing the applicator to roll the false eyelash lengthways onto an eyelid and allowing the rolling false eyelash to release from the applicator. The applicator may be disposable.

21 Claims, 23 Drawing Sheets

Related U.S. Application Data continuation-in-part of application No. 14/599,496, filed on Jan. 17, 2015, now Pat. No. 9,913,506.

(60) Provisional application No. 61/928,901, filed on Jan. 17, 2014.

(56) References Cited

U.S. PATENT DOCUMENTS

| | | | | |
|---|---|---|---|---|
| 1,960,687 | A | 5/1934 | Wills | |
| 2,022,896 | A * | 12/1935 | Nathans | A45D 40/26 401/35 |
| 1,666,116 | A | 4/1938 | Bunnell | |
| D119,329 | S | 3/1940 | Leyne | |
| D129,526 | S | 9/1941 | Hanisch | |
| D133,455 | S | 11/1941 | Tuttle | |
| 2,268,082 | A | 12/1941 | Phillips, Sr. | |
| 2,323,595 | A | 7/1943 | Hanisch | |
| D143,945 | S | 2/1946 | Wolff | |
| D155,157 | S | 9/1949 | Hickey | |
| 2,760,264 | A | 8/1956 | Javits | |
| 3,016,059 | A | 1/1962 | Hutton | |
| 3,333,593 | A | 8/1967 | Mcgivern | |
| 3,339,561 | A | 9/1967 | Brickner | |
| D210,180 | S | 2/1968 | Solomon | |
| D213,239 | S | 1/1969 | Flewwellin | |
| 3,461,886 | A | 8/1969 | Bau | |
| D215,985 | S | 11/1969 | Silson | |
| 3,478,754 | A | 11/1969 | Martin, Jr. | |
| 3,511,248 | A * | 5/1970 | Panda | A41G 5/02 D28/36 |
| 3,516,423 | A | 6/1970 | Seidler | |
| D218,870 | S | 9/1970 | Aylott | |
| 3,547,135 | A | 12/1970 | Roos | |
| 3,556,113 | A | 1/1971 | Frieder | |
| D219,854 | S | 2/1971 | Howard | |
| 3,561,454 | A | 2/1971 | Oconnell | |
| 3,590,828 | A | 7/1971 | Prewitt | |
| D222,518 | S | 10/1971 | Brittain | |
| 3,625,229 | A | 12/1971 | Silson | |
| 3,654,939 | A | 4/1972 | Davison | |
| 3,670,742 | A | 6/1972 | Weaner | |
| 3,722,519 | A | 3/1973 | Epstein | |
| D328,504 | S | 8/1992 | Davies | |
| 5,927,295 | A | 7/1999 | Quinones | |
| D430,955 | S | 9/2000 | Ishida | |
| D437,086 | S | 1/2001 | Dickert | |
| D449,408 | S | 10/2001 | McMillan | |
| D455,521 | S | 4/2002 | Park | |
| D503,494 | S | 3/2005 | Yamashita | |
| D559,449 | S | 1/2008 | Lin | |
| D573,307 | S | 7/2008 | Cho | |
| D576,352 | S | 9/2008 | Brestoni | |
| D581,096 | S | 11/2008 | Zhang | |
| D587,899 | S | 3/2009 | Rauno et al. | |
| D600,857 | S | 9/2009 | Maddy | |
| D609,403 | S | 2/2010 | Cho | |
| D611,657 | S | 3/2010 | Maddy | |
| D629,201 | S | 12/2010 | Denarco | |
| D630,794 | S | 1/2011 | Cohen Harel et al. | |
| 8,015,980 | B2 | 9/2011 | Elliot | |
| 8,196,591 | B2 | 6/2012 | Lee et al. | |
| D674,182 | S | 1/2013 | Copeland et al. | |
| D677,004 | S | 2/2013 | Flynn | |
| 8,424,542 | B1 | 4/2013 | Han | |
| D721,856 | S | 1/2015 | Vikkarreal | |
| 9,215,901 | B1 | 12/2015 | Schroeder | |
| D757,359 | S | 5/2016 | Van Keppel et al. | |
| D779,736 | S | 2/2017 | Hansen | |
| D788,985 | S | 6/2017 | Hansen | |
| D800,384 | S | 10/2017 | Hansesn | |
| 9,913,506 | B2 | 3/2018 | Hansesn | |
| 11,051,570 | B2 | 7/2021 | Hansen | |
| 2002/0189628 | A1 | 12/2002 | Iosilevich | |
| 2005/0166939 | A1 | 8/2005 | Stroud | |
| 2009/0223534 | A1 | 9/2009 | Green | |
| 2012/0136748 | A1 | 5/2012 | Shasteen | |
| 2013/0042884 | A1 | 2/2013 | Wilkimson | |
| 2013/0160783 | A1 | 6/2013 | Ahn et al. | |
| 2018/0160755 | A1 | 6/2018 | Hansen | |

FOREIGN PATENT DOCUMENTS

| | | | |
|---|---|---|---|
| GB | 1021063 | A | 2/1966 |
| GB | 1307107 | A | 2/1973 |
| JP | 2011005013 | A | 1/2011 |
| JP | 2012072510 | A | 4/2012 |
| JP | 2017502823 | A | 1/2017 |
| KR | 1020160110971 | A | 9/2016 |
| WO | 201509266 | A1 | 7/2015 |

OTHER PUBLICATIONS

KR Patent Application No. 10-2016-7022291 filed Aug. 16, 2016, entitled False Eyelash Apparatus and Methods by Hal J Hansen.

JP Patent Application No. 2016-565123 filed Jul. 14, 2016, entitled False Eyelash Apparatus and Methods by Hal J Hanson.

CA Patent Application No. 2,936,859 filed Jan. 15, 2015, entitled entitled False Eyelash Apparatus and Methods by Hal J Hanson.

EP Patent Application No. EP15737533.8 filed Jan. 17, 2015, entitled entitled False Eyelash Apparatus and Methods by Hal J Hanson.

EP Patent Application No. 19216753.4 filed Jan. 17, 2015, entitled entitled False Eyelash Apparatus and Methods by Hal J Hanson.

Non Final Rejection dated Oct. 17, 2016, on a U.S. Appl. No. 14/599,496, filed Jan. 17, 2015.

Final Rejection dated Jun. 13, 2017, on a U.S. Appl. No. 14/599,496, filed Jan. 17, 2015.

Notice of Allowance dated Oct. 30, 2017, on a U.S. Appl. No. 14/599,496, filed Jan. 17, 2015.

Non Final Rejection dated Mar. 13, 2019, on a U.S. Appl. No. 15/215,571, filed Jul. 20, 2016.

Final Rejection dated Nov. 4, 2019, on a U.S. Appl. No. 15/215,571, filed Jul. 20, 2016.

Non Final Rejection dated Jun. 30, 2020, on a U.S. Appl. No. 15/215,571, filed Jul. 20, 2016.

Notice of Allowance dated Mar. 4, 2021, on a U.S. Appl. No. 15/215,571, filed Jul. 20, 2016.

Notice of Allowance dated Mar. 16, 2021, on a U.S. Appl. No. 15/215,571, filed Jul. 20, 2016.

International Search Report dated May 11, 2015, on a PCT No. PCT/US2015/011873, filed Jan. 17, 2015.

Written Opinion dated May 11, 2015, on a PCT No. PCT/US2015/011873, filed Jan. 17, 2015.

U.S. Appl. No. 61/928,901, filed Jan. 17, 2014, issued Jan. 17, 2014.

Restriction Requirement dated Jun. 16, 2016, for Design U.S. Appl. No. 29/522,564.

Non Final Rejection dated Dec. 31, 2020, on U.S. Appl. No. 15/894,823, filed Feb. 12, 2018.

Final Rejection dated Jun. 14, 2022, on U.S. Appl. No. 15/894,823, filed Feb. 12, 2018.

aliexpress.com, "False Eyelash Applicator Mascara EyeLash Eye Lash Fake Clip Tool", http://www.aliexpress.com/item/Hot-Sell-5pcs-Iot-False-Eyelash-Applicator-Mascara-EyeLash-Eye-Lash-Fake-Clip-Tool-Free-Shipping/1360080576.html, accessed Jan. 2, 2014, 9 pages.

beautyjunkiesunite.com, "Make Applying False Lashes Easy with the Ardell Pro Lash Applicator", http://www.beautyjunkiesunite.com/WP/2013/11/11/make-applying-false-lashes-easy-with-the-ardell-pro-lash-applicator/, Nov. 11, 2013, 7 pages.

sephora.com, "Bulls Eye Lash Applicator", http://www.sephora.com/bulls-eye-lash-applicator-P374552, accessed Jan. 2, 2014, 4 pages.

"Mini Portable cosmetic Eyelash Curl Curling Clamp", www.paywithless.com/makeup/4166-1-pcs-mini-portable-cosmetic-eyelash-

(56) References Cited

OTHER PUBLICATIONS curl-curling-clamp-for-woman-color-random.html, accessed Jan. 3, 2014, 31 pages.

* cited by examiner

FALSE EYELASH APPARATUS AND METHODS

CROSS REFERENCE TO RELATED APPLICATIONS

This application is a continuation of U.S. Non-Provisional application Ser. No. 15/215,571, filed 20 Jul. 2016, which is a continuation-in-part of U.S. Non-Provisional application Ser. No. 14/599,496, filed Jan. 17, 2015, now U.S. Pat. No. 9,913,506, issued on Mar. 13 2018, which claims the benefit of U.S. Provisional Application No. 61/928,901, filed Jan. 17, 2014. The entire contents of the patent applications identified above are incorporated by reference herein as if fully set forth.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

STATEMENT REGARDING FEDERAL RIGHTS

N/A

TECHNICAL FIELD

Embodiments relate to false eyelash apparatus and, more particularly but not exclusively, to false eyelash apparatus for applying false eyelashes to eyelids. Embodiments relate to false eyelash holders for holding false eyelashes. Embodiments relate to loader devices for loading false eyelashes into false eyelash applicators. Embodiments relate to false eyelash applicators for receiving and applying false eyelashes to eyelids. Embodiments relate to false eyelash methods for supporting a false eyelash. Embodiments relate to methods for applying a false eyelash to an eyelid. Embodiments relate to methods of operating the aforementioned apparatus.

BACKGROUND

Since the silent film era, woman have used artificial, fake, false eyelashes or false lashes to make their eyes look more attractive. The difficulty of attaching false lashes is well known.

The false lash must be applied in sections, without allowing the unattached glue laden sections from touching and adhering to the wrong plane of the eyelid or the person's natural eyelashes. The unattached sections are only millimeters from the eyelid and natural eyelashes, it's an art in itself to apply the false lash on the exact proper plane.

If the glue that's applied to the false lash to hold it in place on the eyelid, makes contact with any of the natural eyelashes, the false eyelash must be put aside before attachment is complete and the accidentally applied glue must be removed before beginning again. In the time that it takes, the original glue will start to cure on the false eyelash and also must be removed and then reapplied fresh.

Any makeup that is often pre-applied to the eyelid is thus wiped off or smeared in the glue removal process, and must be reapplied before again attempting re-applying the false eyelash.

This is why women pay beauty salons from $45-$200 for professional false lash attachment. The fact that beauty salons are so widely used underscores the fact that hand application and the prior art have not solved this problem Various devices have been employed to help achieve this. Known applicators have not solved the problem of providing an easy and precise application means.

There is a need to provide an improved apparatus and method for use in applying false eyelashes.

SUMMARY

According to one aspect, a false eyelash holder is provided. The false eyelash holder has a support member for supporting a false eyelash. The support member is configured to be adjustable between a first configuration and a second configuration. In the first configuration, the false eyelash is supportable in a convex shape on the support member. In the second configuration, the false eyelash is supportable in a substantially concave shape on the support member. When the convex shaped false eyelash is supported on support member in the first configuration, the support member is adjustable from the first configuration to the second configuration in which the supported eyelash is substantially concave shaped so as to cause inversion of the shape of the false eyelash from the convex shape to the substantially concave shape.

In one approach, the false eyelash holder to which the false lash is attached, has a built in post that allows the lash to be inverted, to allow insertion into an applicator. The loader/inverter inverts the lash; convex to concave. It may have a post to allow the applicator/clamp to pick up the lash at the exact correct angle.

In another approach, a false eyelash holder is provided in which the false eyelash is pre-loaded and pre-inverted, for example at a factory facility, and thus its not needed to inverted by the consumer.

According to another aspect, a false eye lash applicator is provided. The applicator has a clamp configured to be adjustable between a closed position and a neutral position. In the closed position the clamp is capable of gripping a false eyelash being supported in a substantially concave shape by an eyelash holder and is capable of pulling the false eyelash in the concave shape off from the eye lash holder. In the neutral position; the clamp has released grip of the false eyelash and loosely carries the concave shaped false eyelash for allowing said applicator to roll the false eyelash lengthways onto an eyelid and release the false eyelash from said applicator.

In one approach, once the lashes are inside the applicator/clamp, glue or other suitable adhesive medium can easily be applied, as the lash band of the false eyelash is from 0.25-5 mm away from the clamp's edge and the lashes themselves are semi-rigid, holding the lash band firmly in place for easy gluing. In one example, a pre-applied or user-applied glue strip is adopted as the adhesive medium, eliminating the need to manually apply glue. Once the glue has dried to appropriate tackiness, the applicator/clamp goes to a 'neutral' position so that as the lash is 'rolled' onto the eyelid, the applicator/clamp releases the lash without measurable restriction, i.e.; the glue holds the lash band onto the eyelid and the applicator clamp does not.

In some examples, the applicator could be reusable or disposable. The applicator may be flat or curved or a combination of both. The curved applicator keeps the lashes curved 'up' as natural eyelashes are, during storage.

In one approach, a system comprises an artificial eyelash holder, which flexes and inverts from concave to convex. The system can include a specific retail holding tray. The system can include a device to invert the false eyelash holder, which then inserts it into a device to apply the false eyelash on an eyelid in a new and easy way.

In another aspect of the present technolgoy, a false eyelash applicator comprises: a false eyelash support, for releaseably supporting a false eyelash to be applied to an eyelid; and a handle portion for manipulating said false eyelash support to apply said false eyelash; wherein said support is configured to rollably support the false eyelash in a lengthwise roll on configuration for rolling, by manipulation of said handle portion, the false eyelash lengthwise laterally over an eyelid and off said support.

In yet another aspect of the present technology, a false eyelash apparatus comprises: a false eyelash having a base and false lashes, wherein said base has an inner side for adhering to an eyelid and an outer side from which said false eyelashes extend away from said base; a false eyelash holder for use in loading the false eyelash into an applicator; wherein said false eyelash holder has a support member having substantially convex shaped outer side, wherein said false eyelash is releaseably supported on said support member outer side and orientated such that the eyelash band inner side faces the support member outer side and the eyelash band outer side faces outwardly away from the support member outer side; and wherein said false eyelash base outer side and said base inner side are supported in a substantially concave shape and convex shape, respectively, on and in nested relation with said support member outer side.

In yet another aspect of the present technology, a method of applying a false eyelash to an eyelid; the method comprising: providing a false eyelash; supporting in a substantially convex shape said false eyelash on a support member in a first configuration; adjusting said support member from said first configuration to said second configuration to invert said false eyelash to a substantially concave or straight shape; applying adhesive to said false eyelash and/or an eyelid; rolling the length of said inverted false eyelash laterally across an eyelid and off said support to adhere said false eyelash to said eyelid.

In yet another aspect of the present technology, a method for holding a false eyelash comprises supporting a false eyelash, inverting the false eyelash shape from a convex shape to a substantially concave shape, and supporting said inverted false eyelash for loading into an applicator.

In yet another aspect of the present technology, a method for applying a false eyelash, the method comprises clamping a false eyelash being supported in a concave shape by an eyelash holder, pulling off said false eyelash from said eye lash holder whilst clamping said false eyelash in said substantially said concave shape; and releasing and loosely carrying said substantially concave shaped false eyelash; rolling said false eyelash onto an eyelid and releasing said false eyelash from said applicator.

According to yet another aspect, the present technology is directed to one or more devices or methods comprising one or more of the structural, functional, or ornamental features described herein.

According to yet another aspect, the present technology is directed to a false eyelash holder for loading a false eyelash into an applicator. The holder may comprise a false eyelash support member. The support member has an outer side which is flat, near flat or substantially concave shaped along a length thereof.

DETAILED DESCRIPTION OF THE PREFERRED EMBODIMENTS

Figure 1:
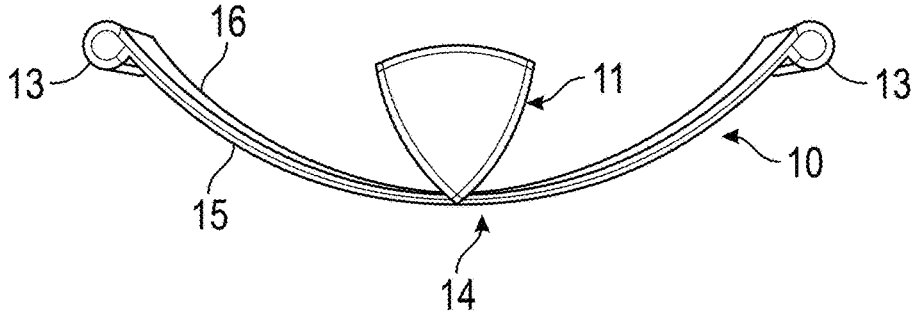
FIG. 1 is a top view of the flexible-invertible false eyelash holder in the form of a Flex-Band according to one embodiment.

In the following description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Certain terminology is used in the following description for convenience only and is not limiting. The words "right," "left," "top," and "bottom" designate directions in the drawings to which reference is made. The words "a" and "one," as used in the claims and in the corresponding portions of the specification, are defined as including one or more of the referenced item unless specifically stated otherwise. This terminology includes the words above specifically mentioned, derivatives thereof, and words of similar import. The phrase "at least one" followed by a list of two or more items, such as "A, B, or C," means any individual one of A, B or C as well as any combination thereof.

For the purpose of illustrating the invention, there are shown in the drawings embodiments, which are presently preferred. It is understood, however, that the invention is not limited to the precise arrangements and instrumentalities shown.

Reference will now be made to the drawings in which the various elements of embodiments will be given numerical designations and in which embodiments will be discussed so as to enable one skilled in the art to make and use the invention. Specific reference to components, process steps, and other elements are not intended to be limiting. Further, it is understood that like parts bear the same reference numerals, when referring to alternate figures. It will be further noted that the figures are schematic and provided for guidance to the skilled reader and are not necessarily drawn to scale. Rather, the various drawing scales, aspect ratios, and numbers of components shown in the figures may be purposely distorted to make certain features or relationships easier to understand.

The term "false eyelash" or "false eyelashes" refers herein to any false lashes arranged in strip or on a band (also referred hereinto as base) and designed to be worn. The false eyelashes can be made from any material suitable for forming the false eyelashes and that allows the false eyelashes to be inverted and applied to an eyelid as described below. By way of example, the false eyelashes can be made with human hair, animal hair, fur, synthetic/artificial materials or any combination thereof. In some examples, the lashes can be temporary lashes designed to be worn for a short period.

Figure 2:
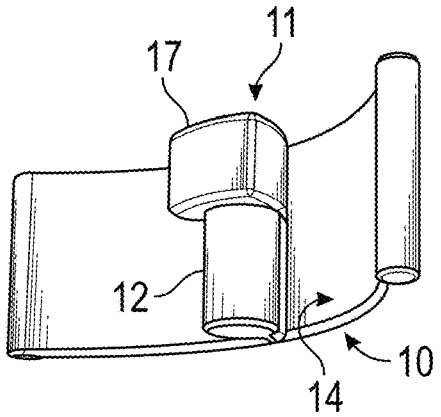
FIG. 2 is a rear, bottom perspective view of the Flex-Band of FIG. 1.

A false eyelash holder for loading a false eyelash into an applicator according to one or more embodiments will now be described with reference to the accompanying drawings. FIG. 1 is a top view of the false eyelash holder according to one embodiment. FIG. 2 is a rear, bottom perspective view of the holder of FIG. 1. False eyelash holder 10 has a support member 14 for supporting a false eyelash.

Figure 3:
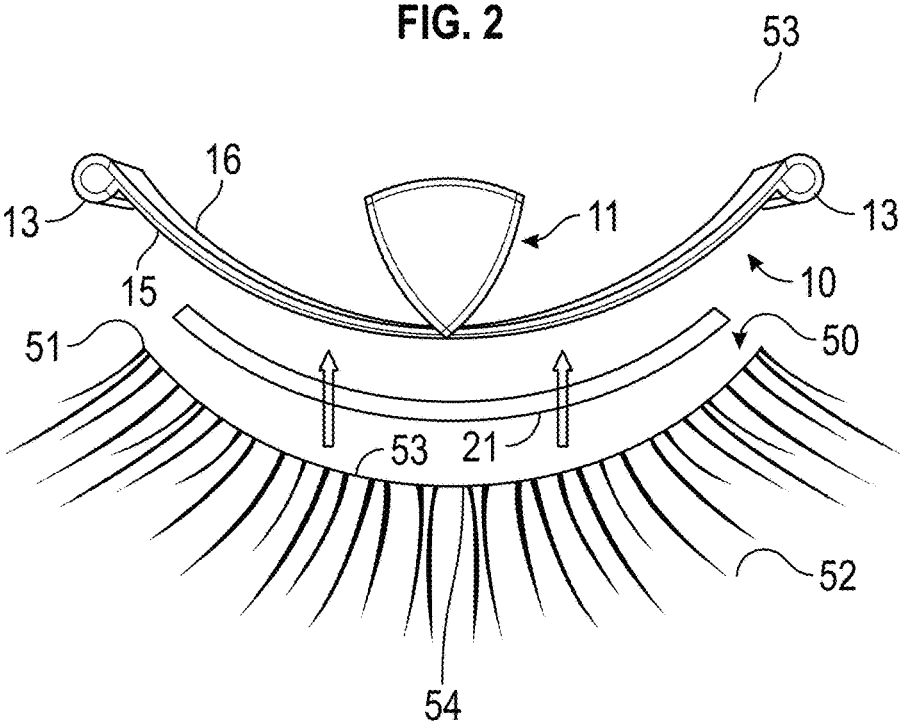
FIG. 3 is a top view of the holder of FIG. 1. and a false eyelash being arranged ready for attaching to the Flex-Band according to one example.
Figure 4:
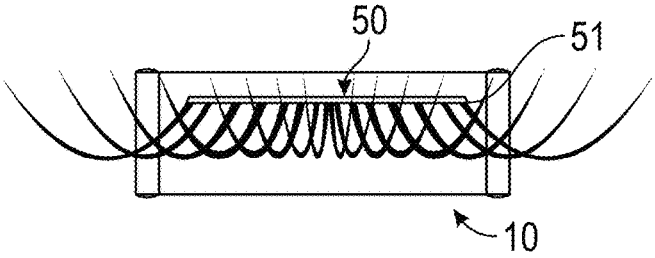
FIGS. 4 & 5 are front and perspective views, respectively, of the false eyelash releaseably adhered to the Flex-Band according to one embodiment.
Figure 5:
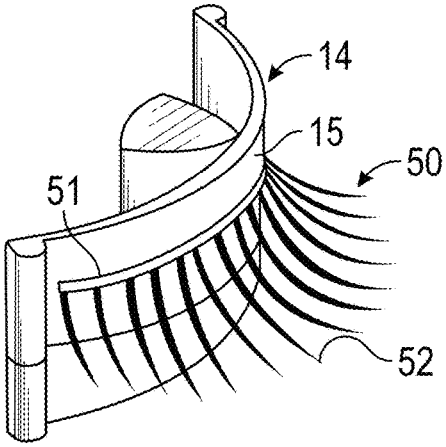

FIG. 3 is a top view of false eyelash holder 10 and a false eyelash 50 being arranged ready for attaching to holder 10 according to one example. Attaching of the false eye lash 50 to eyelash holder 10 may be for example performed by the false eyelash manufacturer and/or by people who want to reuse their used false eyelashes. FIGS. 4 and 5 are front and perspective views, respectively, of eyelash holder 10 with false eye lash 50 attached thereto.

As best shown in FIGS. 3 to 5, false eyelash 50 has a base 51 and false lashes 52, which extend outwardly away from the base. False eyelash base 51 has an inner side 53 for adhering to an eyelid and outer side 54 from which false lashes 52 extend away from base 51. In some embodiments, false eyelash 50 is a conventional type crescent shaped false eyelash, which in isolation, generally assumes or defaults to a convex shape in which base outer side 54 and base inner side 53 are generally convex and concave shaped, respectively. Convex or convex shaped is used herein to mean has an outline or surface that is curved outwards, like the exterior of the eye. Concave or concave shaped is used herein to mean the opposite of convex, that is, has an outline or surface that is curved inwards.

In alternative embodiments, the false eyelash, can, in isolation, assume other default shapes.

As will be explained in more detail below, eyelash holder support member 14 is configured to be adjustable between a first configuration and a second configuration.

In the first configuration of support member 14, false eyelash 50 is supportable in a convex shape on support member 14. By way of example, false eyelash 50 of FIG. 3, which is supported on the support member in the first configuration, is shown in FIGS. 4 & 5 according to one embodiment. In the first configuration, support member 14 has a substantially convex shaped outer side 15 which serves as a false eyelash attachment surface. False eyelash 50 is releaseably supported on support member outer side 15 and orientated such that base inner side 53 faces and is attached to support outer side 15 and base outer side 54 faces outwardly away from the support outer side 15. In this manner, false eyelash base outer side 54 and base inner side 53 are supported in a substantially convex shape and concave shape, respectively, on and in nested relation, with support member outer side 15. False eyelash 50 may be releaseably adhered to support member 14 by a suitable adhesive medium, such as glue or other adhesive layer 21, applied to support member outer side 15 and/or base inner side 53 (see FIG. 3). In alternative embodiments, attachment means other than adhesive medium may be adopted. In other embodiments, the attachment means for attaching the false eyelash to the support member may be clips, latches, magnet material placed on both the eyelash base and support member, or any other suitable retaining means capable of releaseably retaining the false eyelash in the required configurations on the support member.

Figure 14:
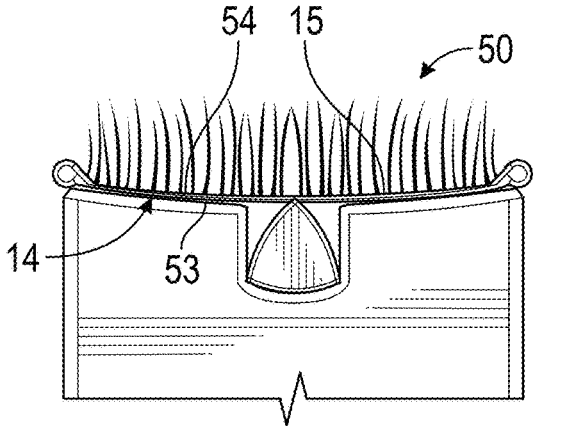
FIG. 14 is a partial top view of the receiving end of the inverter-loader, showing the loaded Flex-Band and false eyelash carried thereon in an example inverted position and ready to be loaded into the eyelash applicator according to one embodiment.

In the second configuration of support member 14, false eyelash 50 is supportable in a substantially concave shape on support member 14. By way of example, false eyelash 50 supported on support member 14 in the second configuration is shown in FIG. 14 according to one embodiment. In the second configuration, support member outer side 15 is substantially concave shaped. False eyelash 50 is releaseably supported on support member outer side 15 and orientated such that base inner side 53 faces support outer side 15 and base outer side 54 faces outwardly away from the support outer side 15. In this manner, the false eyelash base outer side 54 and base inner side 53 are supported in a substantially concave shape and convex shape, respectively, on and in nested relation, with support member outer side 15.

In the embodiment shown in FIGS. 1-5, support member 14 is made from a flexible strip or band of material that has sufficient elasticity to allow the shape of the support member to be invertible lengthwise from the substantially convex shape in the first configuration to the substantially concave shape in the second configuration. Support member 14 made from such a flexible strip or band is also referred to herein as a "Flex-Band". In one embodiment, the flexible strip or band of material may be a rubber strip. In other embodiments, the flexible strip or band may be any other suitable flexible material, such as for example but not limited to plastic, metal, natural and/or synthetic, that is capable of flexing and inverting in the manner described herein with reference to the embodiments.

Furthermore, in other embodiments, the support member 14 need not take the form of a strip or band but may be any shaped flexible body of material with outer side 15. All that is required is that the flexible body has the necessary material properties to maintain outer side 15 in the substantially convex shape in the first configuration and allow the outer side 15 to deform to the substantially concave shape in the second configuration.

In yet other embodiments, the support member may take yet other forms. For example, the support member may be a structure or mechanism that is capable of changing between a convex and concave shape along the length thereof without necessarily being made of a flexible or elastic material. In yet other embodiments, rather than being made from a continuous solid material as shown in the accompanying figures, the support member may be a non-continuous structure, such as a webbed or frame structure, having the same overall shape of support member 14 or having the overall shape of support member outer side 15 when the support member is in the first and second configurations and being adjustable therebetween. In some embodiments, the support member is made from a structure of more rigid components that are movable relative to each other to change the support member between the convex shape and concave shape When convex shaped false eyelash 50 is supported on support member 14 in the first configuration, support member 14 is adjustable from the first configuration to the second configuration so as to cause inversion of the shape of false eyelash 50 from the convex shape to the substantially concave shape. As will become more apparent below, the radius of curvature of the base of the false eyelash in the second configuration is a radius that generally corresponds to a radius of curvature of the outer side of an Applicator according to an aspect of the present technology (see for example Applicator 200). In some embodiments, any radius of curvature that allows the false eyelash, loaded in the Applicator, to be rollable by the Applicator lengthwise laterally over the eyelid and off the Applicator is envisaged.

In some embodiments, the shape of the false eyelash may not need to be fully inverted to a concave shape in the second configuration but may still allow the false eyelash, when applied in the second configuration, to be rollable by the Applicator onto the eyelid. In other embodiments, in the second configuration of support member 14, false eyelash 50 is supportable in a substantially straight or flat shape rather than concave shape on support member 14. Adjusting support member 14 from the first configuration to the second configuration causes only partial inversion of the shape of false eyelash 50, which changes from convex to substantially straight rather than causing full inversion of false eyelash 50. In yet further embodiments, in the second configuration, the false eyelash 50 remains supported in a convex shape but has a radius of curvature that is very, very large compared to the radius of curvature of the eyelid.

As will be explained in more detail below, adjusting support member 14 from the first to the second configuration to cause the aforementioned changes in shape of the false eyelash 50, allows false eyelash 50 to then be easily loaded into an applicator in the shape required for rolling false eyelash 50 onto an eyelid.

Another aspect of the present technology will now be described. In one approach, support member 14 is adjustable from the first configuration to the second configuration with the aid of a support member inverter device. An inverter device according to one aspect will now be described with reference to the accompany drawings of FIGS. 7-14.

Figure 7:
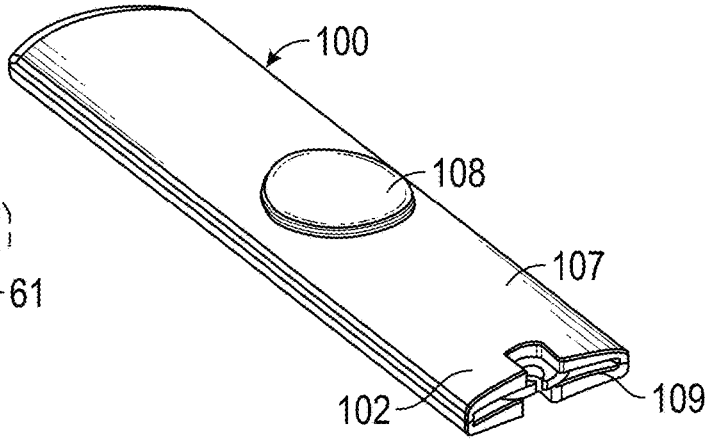
FIG. 7 is a perspective view of the false eyelash inverter-loader device in a retracted position according to one embodiment.
Figure 8:
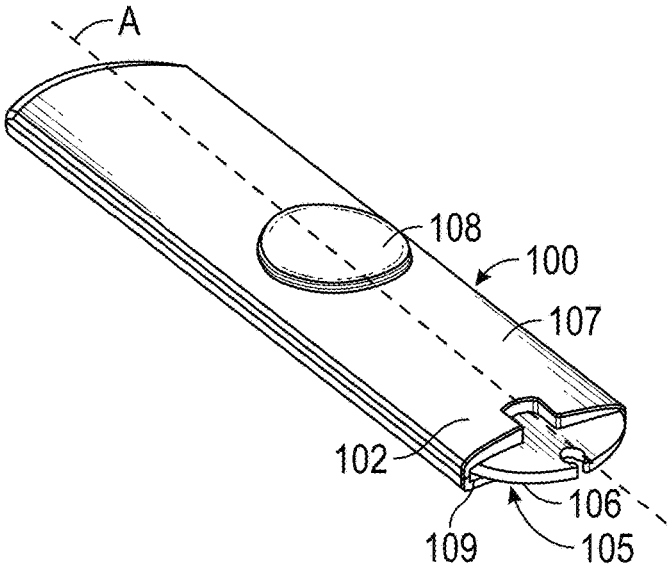
FIG. 8 is a perspective view of the inverter-loader device of FIG. 7 shown in a Flex-band receiving position according to one embodiment.

FIG. 7 is a perspective view of false eyelash inverter device 100 in a retracted position according to one embodiment. FIG. 8 is a perspective view of inverter device 100 shown in a Flex-band receiving position according to one embodiment. Inverted device 100 has a receiving member 105 configured to receive false eyelash holder 10. Inverted device 100 includes an inverter mechanism configured to mechanically adjust the flex-band from the first configuration to the second configuration, and, if need be, hold the flex-band in the second configuration for loading the false eyelash into a false eyelash applicator.

In one embodiment, inverter mechanism is a puller system formed by a handle housing 107 and false eyelash holder receiving member 105, which is slidably mounted in the housing 107. Handle housing 107 is generally a sheath like casing or structure having an open-ended interior cavity 109 extending longitudinally from handle end 102 into the handle. Cavity 109 has a generally rectangular cross-section. Receiving member 105 is slidably mounted in cavity 109 at handle end 102 such that receiving member 105 is slidable in the cavity between an extended position, in which the distal end of the receiving member 105 protrudes out from the handle end, and a retracted position in which receiving member 105 is retracted or pulled along a longitudinal axis A of the housing into handle end 102 and the receiving member distal end is located within handle end 102 (see FIGS. 7 & 8). Receiving member 105 is a substantially planar slider member dimensioned to be slidable longitudinally in the housing cavity in response to actuation of thumb button 108.

In some embodiments, a slidable button protrudes from the handle housing and provides a thumb or finger contact surface portion for actuation on the exterior of the handle housing. The button is coupled to receiving member 105 such that sliding movement of the button causes sliding movement of the receiving member between the extended and retracted positions. Any actuator mechanism that is manually or automatically operable to cause movement of the receiving member between the extended and retracted positions is envisaged.

Figure 9:
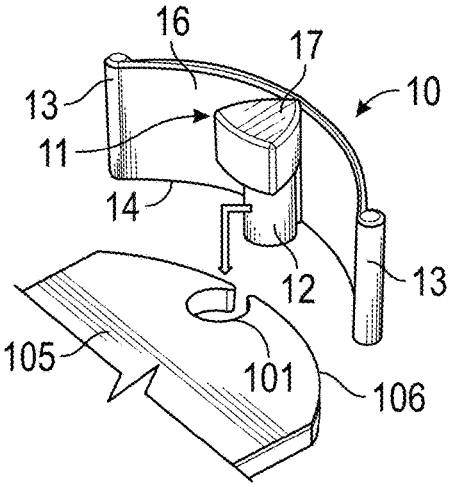
FIG. 9 is a partial rear, top perspective view the Flex-Band receiving end of the inverter-loader device and the Flex-Band of FIG. 8 ready to be inserted into the inverter-loaders's puller according to one embodiment.
Figure 10:
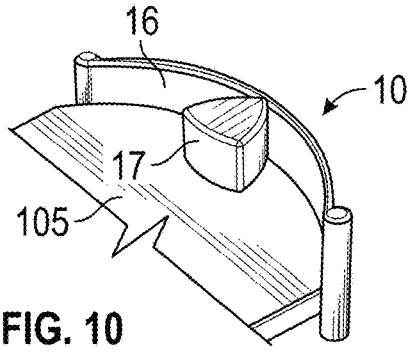
FIG. 10 is a partial top perspective view of the Flex-Band receiving end of the inverter-loader device and the Flex-Band of FIG. 9 inserted therein according to one embodiment.

Receiving member 105 is configured to securely retain false eyelash holder 10, on receiving member 105 in a position in which the flex band is in the first configuration and is upright or perpendicular relative to the plane in which member 105 is slidable (see FIGS. 9 & 10). When false eyelash holder 10 is so retained, retracting receiving member 105 into handle cavity 109 causes opposite ends of the Flex-Band to abut the handle housing end and adjust the flex band from the first configuration to the second configuration.

Receiving member 105 is adapted and arranged to cooperate with the type of support member 14 used. In the embodiment of FIGS. 7-9, receiving member 105 has a substantially convex shaped outer end side 106 for initially supporting, in nested relation, the flex band in the substantially convex shape. Receiving member 105 and eyelash holder 10 are designed to cooperate and engage with one another such that, when the Flex-Band is retained in the first configuration on receiving member 105, a generally central segment of the flex band is retained in a fixed position on member 105 whereas the rest of the flex band is free to flex and bend. In one embodiment, this is achieved by including on holder 10 alignment post 11 which is integrated or mounted generally centrally on inner side 16, opposite outer side 15, of the Flex Band as shown in FIGS. 7-9. As best shown in FIG. 9, post 11 extends from top to bottom along the band inner side 16 with a longitudinal edge of the post fixed to inner side 16.

Receiving member 105 includes a locating hole 101 extending perpendicular to the handle longitudinal axis for receiving alignment post 11 therein to retain holder 10 upright on receiving member 105. Locating hole 101 is formed contiguous with the perimeter edge of receiving member outer end side 106 so as to provide an access gap or opening into locating hole from the exterior. The gap permits the flex band to overlap outer end side 106 when the flex band is being retained on receiving member 105 by alignment post 11 inserted in locating hole 101. In the embodiment shown in the figures, post 11 has a head 17, having larger cross section than post body 12, for seating on an upper surface of receiving member 105 when post body 12 is disposed in the locating hole 101. Post 11 together with locating hole 101 serve to retain and self align the flex band in the correct orientation and height on receiving member 105 with the support member 14 overhanging outer end side 106. By way of example, FIG. 10 is a top perspective view of inverter device 100 showing the Flex-Band inserted therein according one embodiment.

In the figures, post head 17 has a generally triangular cross-section with convex sides and post body 12 is of generally circular cross section, however, other shaped cross-sections are envisaged. Furthermore, in other embodiments, post 11 need not have a larger post head, and may simply be a post that holds the flex band at the correct height on receiving member 105 by means of a frictional fit. The cylindrical end pieces on the Flex-Band are spacers 13 that are explained in more detail below.

Figure 11:
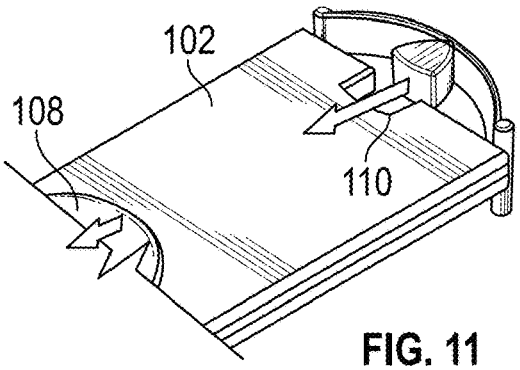
FIG. 11 is a partial perspective view indicating the direction in which a thumb button of the inverter-loader and the puller can be pulled back for inverting the loaded Flex-Band and an artificial false eyelash carried thereon from concave to convex according to one embodiment.
Figure 12:
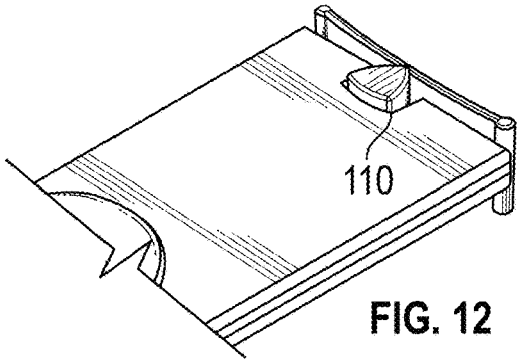
FIG. 12 is a partial perspective view of the inverter-loader shown in FIG. 11, showing the loaded Flex-Band in an example inverted position as a result of the puller of the inverter-loader being pulled back in the direction indicated in FIG. 11.

FIG. 11 is a perspective view of inverter 100 in the extended position preparatory to thumb actuation and indicating the direction in which thumb button 108 and receiving member 105 is being pulled back for inverting the loaded Flex-Band, and any false eyelash carried thereon, from convex to concave. FIG. 12 is a perspective view of inverter 100, showing the loaded Flex-Band in an exemplary inverted position as a result of receiving member 105 being pulled back in the direction indicated in FIG. 11.

As illustrated by FIGS. 10-12, when false eyelash holder 10 is so retained in the first configuration by the receiving member 105 in the extended position, retracting receiving member 105 into cavity 109 causes the substantially concave shaped flex band to be pulled towards housing end 102 and opposing distal ends 13 of the flex band to abut end 102. As the flex band is free to flex (except for the central segment attached to the post edge and opposing distal ends 13), further retracting of receiving member 105 causes inversion of the shape of the flex band from the substantially convex shape to a substantially concave shape to thereby adjust the flex band to the second configuration. Alignment post head 12 is received in handle housing end open notch 110 to allow receiving member 105 to retract sufficiently to cause the inversion.

In the embodiment shown in FIGS. 7 & 8, handle housing 107 is substantially planar, receiving member 105 is a substantially planar slider, and cavity 109 is in the form of an open ended longitudinal slot. However, in other embodiments, handle housing 107, receiving member 105 and cavity 109 may be of other shapes and arrangements that enable the receiver member and inverter mechanism to perform the desired function.

Furthermore, in other embodiments, the handle housing, receiving member and cavity need not be arranged to enable single handed operation of the inverter. Two handed operation is envisaged in other embodiments. In yet further embodiments, the inverter device is automated. For example, electronic, magnet, and/or hydraulic actuators may be incorporated in the inverter device in place of, or in addition to, the thumb actuated button, for moving the receiving member between the extended and retracted positions. The automated actuator may be controlled manually or by means of computer or electronic controller.

In yet other embodiments, rather than adopting a puller system, the inverter device is formed as a pusher system. For example, in one embodiment a push version of the inverter device may be adopted that is configured to push the Flex Band to invert the Flex-Band. Any means capable of inverting, partially inverting, or changing the shape of the Flex-Band as described herein with reference to embodiments is envisaged.

In the embodiment shown in FIGS. 7 to 14 of the drawings, inverter device 100 is configured to adjust support member 14, which is a flex band, so as to cause inversion of the band and any eyelash mounted thereon. However, it will be understood that in other embodiments, inverter device may be configured to adjust the flex-band to cause only partial inversion or change the shape as described herein with reference to other embodiments. It is also envisaged that in other embodiments, inverter device is configured to adjust other types of support members of embodiments described herein.

Figure 13:
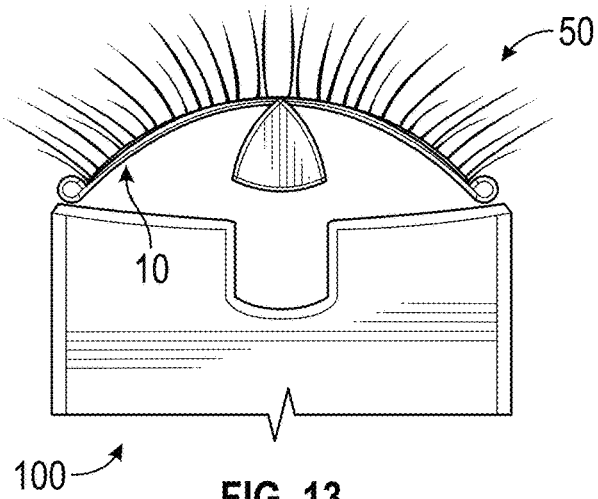
FIG. 13 is a partial top view of the Flex-Band carrying a false eyelash, loaded in the receiving end of the inverter-loader, ready to be inverted according to one embodiment.

The inverter device and false eyelash holder of the embodiments make inverting false eyelashes effortless. A user simply reliably adheres a regular crescent shaped false eyelash 50 to the flex band in the first configuration as shown in FIG. 13, loads the flex band into inverter device 100, and then operates the inverter device to pull the flex-band on itself into the second configuration and cause false eyelash 50 mounted thereon to change from convex to concave shape. FIG. 14 is a top view of the inverter 100, showing the Flex-Band in the second configuration with false eyelash 50 in an example inverted position and ready to be loaded into an eyelash applicator according to one example.

Figure 6:
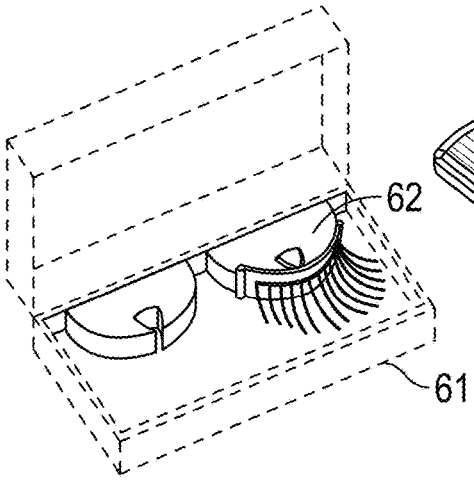
FIG. 6 is a perspective view of a false eyelash tray holding a false eyelash supported on a false eyelash holder according to one embodiment.

In one embodiment, false eyelash 50 is pre-supported on the flex band in the first configuration so that an end user only need load the eyelash holder into inverter device and actuate the inverter to invert false eyelash 50. To this end, eyelash holders 10 having false eyelashes 50 releaseably adhered thereon can be provided in a tray or other holder ready for inversion. By way of example, FIG. 6 is a perspective view of a retail holder tray holding false eyelash holder 10 in a first configuration with false eyelash 50 releaseably adhered to the Flex-band, and an associated retail box 61 in which the holder tray 62 is inserted according to one embodiment.

In one aspect, the flex-band or other support member of the eyelash holder of the embodiments described herein is manufactured from a material that has a "memory" property, such as Polypropylene, causing the flex-band to naturally revert to a default configuration when released from being held in the first or second configuration. In some embodiments, the flex-band default configuration is the first configuration in which the flex-band is in the concave or half moon like shape, and to which the flex-band naturally reverts when released from the second configuration.

Removing the flex band from the inverter device, results in the flex band naturally reverting or snapping back into its first configuration. In such cases, the inverter-loader device can be employed to maintain the flex band in the inverted configuration whilst loading the eyelash into the applicator.

However, in other embodiments, the flex band need not be made of such memory type plastic or other material and may revert to different shape or remain in the second configuration after it is released from the inverter-loader device.

Figure 15:
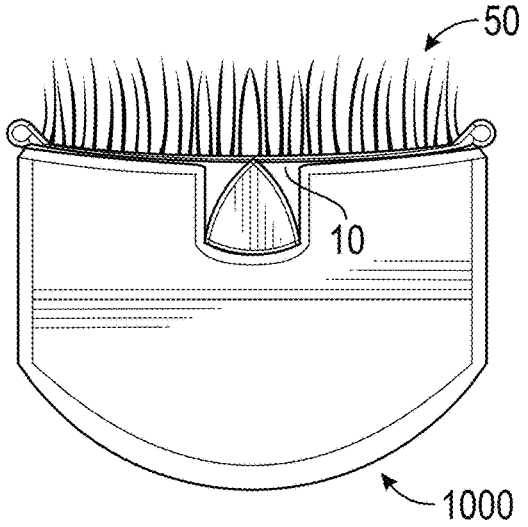
FIG. 15 is a top view of a Flex Band holder according to one embodiment, with a loaded pre-inverted Flex-Band and false eyelash carried thereon, ready to be loaded into the eyelash applicator according to one embodiment.

According to one aspect, a portable holder is provided to hold the flex-band or other support member in the second configuration and the eyelash thereon. One such holder according to an embodiment is shown in FIG. 15. Portable holder 1000 has an end similar to inverter handle housing end 102 but does not include any inverter mechanism as such. Holder 1000 serves as a handle to allow the user to grip the flex-band in the second configuration for loading eyelash 50 into an applicator.

In some embodiments, the flex band is manufactured so that it has a default configuration which is the second configuration in which the flex-band takes the inverted or substantially straight shape. Manufacturing the flex-band so that the flex band naturally maintains the inverted or near flat shape is beneficial for applications where the flex band is to be delivered pre-inverted to the end user as it ensures that the flex band remains pre-inverted for use. This is appropriate for example in disposable applications and other one-time use applications. As will become more apparently below, a flex-band that naturally defaults to the inverted shape is also advantageous in that an inverted false eyelash carried thereon can be easily loaded in the applicator without the end user having to first use an inverter device to invert the flex-band and maintain the flex-band in the inverted configuration.

As mentioned above, in some embodiments the flex-band may be pre-inverted by the manufacturer or other user. In such embodiments, the flex-band or other support member carrying the false eyelash thereon is adjusted to the second configuration (inverted or straight) using suitable inverter device that is the same or similar to inverter device 100 and that is operated automatically or manually. The pre-inverted eyelash holder and false eyelash is then removed from the inverter device for storage and later use by the same user, or delivery to an end user.

Reference will now be made to an applicator for applying a false eyelash to an eyelid according to one aspect. A false eyelash applicator has a false eyelash support, for releaseably supporting a false eyelash in an inverted or near flat shape to be applied to an eyelid; and a handle portion for manipulating said false eyelash support to apply said false eyelash. As will be made apparent with reference to the following embodiments, the applicator false eyelash support and/or handle portion can take various forms.

As will be explained in more detail below, the support is configured to rollably support the inverted or near flat false eyelash in a lengthwise roll on configuration for rolling, by manipulation of the handle portion, the false eyelash lengthwise laterally over an eyelid and off the support. In some embodiments, the applicator false eyelash support has an outer side shaped for rollably supporting the false eyelash in a substantially inverted shape (concave shape), the inner side of a base of the false eyelash being arrangeable in a substantially convex shape on or beyond the exterior of the applicator outer side. In other embodiments, the applicator false eyelash support has an outer side shaped side for rollably supporting the false eyelash in a substantially straight or flat shape, the inner side of the base of the false eyelash being arrangeable in a substantially straight shape on or beyond the exterior of the applicator outer side. In yet other embodiments, the applicator false eyelash support has an outer side shaped for rollably supporting an inner side of a base of the false eyelash in convex shape that has radius of curvature that is much much larger than the radius of curvature of the eye.

Figure 16:
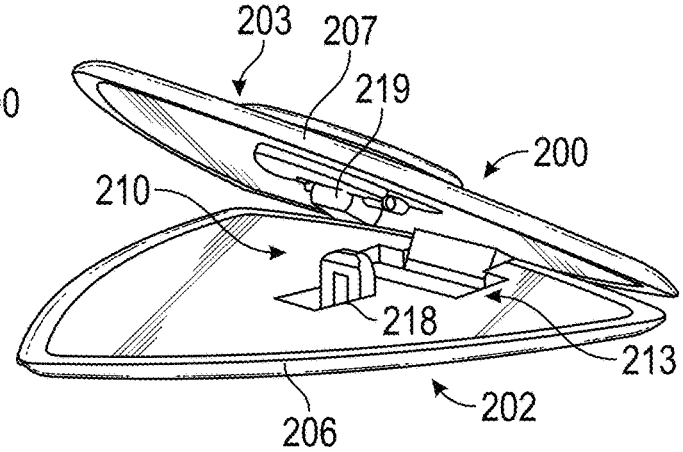
FIG. 16 is a perspective view of an applicator in an open position according to one embodiment.
Figure 17:
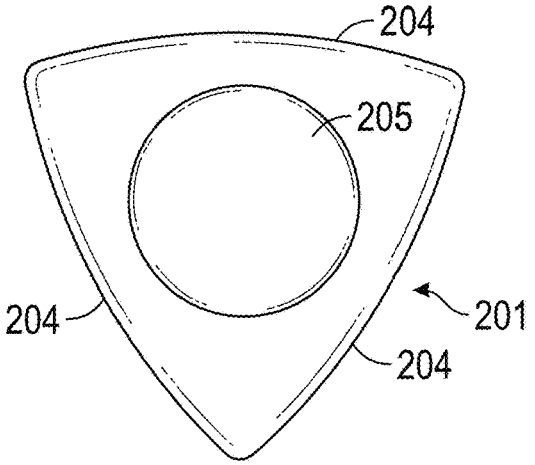
FIG. 17 is a top plan view of the eyelash applicator of FIG. 16 in a closed position according to one embodiment.

Turning in more detail to an Applicator 200 of FIG. 17 according to one embodiment, as a general outline, Applicator 200 has a support portion 201 for supporting inverted or near flat false eyelash, such as but not limited to for example the inverted false eyelash 50 described hereinbefore. Applicator 200 also has a handle portion 205 for manipulating the support portion 201. In the embodiment depicted in FIGS. 16-32, the support portion is a clamp having a first clamp member 202 and a second clamp member 203. Clamp members 202, 203 are operably coupled together and configured to be adjustable between an open configuration (see FIG. 16), a substantially closed configuration (see FIG. 21) and a neutral configuration (see FIG. 22). In the closed configuration, the clamp members 202, 203 are able to tightly grip false lashes 52 extending away from outer side 54 of false eyelash base 51 such that base 51 is held outside clamping members 202, 203 and contiguous therewith, as best shown in FIG. 27. In the neutral configuration, clamp members 202, 203 are able to loosely grip false lashes 52 whilst allowing false eyelash 50 to be releasable without substantial restriction to allow false eyelash to be rolled off the clamp, as will be explained in more detail below.

FIG. 16 is a perspective view of the applicator 200 in an open position according to one embodiment. This position allows an inverted false eyelash 50 to be loaded into applicator 200. FIG. 17 is a top plan view of eyelash applicator 200 in a closed position according to one embodiment. In both the substantially closed configuration and neutral configuration, clamp members 202, 203 together form lengthwise substantially convex shaped applicator outer sides 204. Camp members 202, 203 are generally rectangular planar like shells having complimentary lengthwise convexly shaped outer sides 206 and 207, respectively (see FIG. 16) Each pair of associated clamp member sides 206, 207 form an applicator outer side 204 in the closed or neutral configuration. The radius of lengthwise curvature of the clamping member outer sides 206, 207 and lengthwise curvature of the inverted false eyelash are similar. This allows the inverted false eyelash to be arranged in the applicator in a position in which the inverted eyelash band is located on or beyond the exterior of the applicator side 204 and curves lengthwise along the applicator side 204, as for example shown in FIGS. 25-27. In other embodiments, the clamping members may be of other shapes and/or have more or less convex sides 206, 207 than members 202, 203, which serve the same purpose of gripping and nesting with false eyelash 50. For example, in one embodiment, clamp members 202, 203 each have a single convex shaped outer side 206,207 that together form a single convexly curved outer side 204.

As shown in FIG. 16, clamp members 202, 203 are arranged with their internal faces opposing one another and pivotally interconnected by means of a hinge 213 placed between the opposing internal faces and proximate a common periphery of the clamp members. Hinge 213 is an expandable hinge. In other embodiments, hinge 213 is unexpandable.

Figure 18:
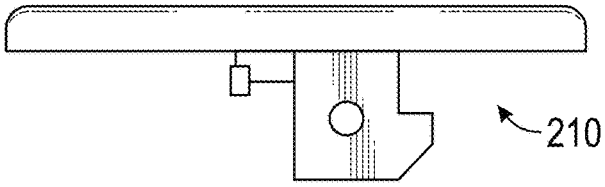
FIG. 18 is an isolated side view of part of the thumb operated latch of the applicator of FIG. 16 according to one embodiment.
Figure 19:
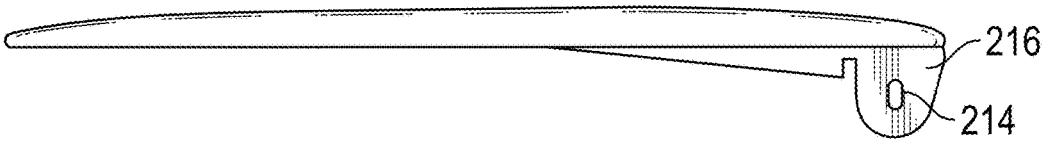
FIG. 19 is an isolated side view of the top half of the applicator of FIG. 16.
Figure 20:
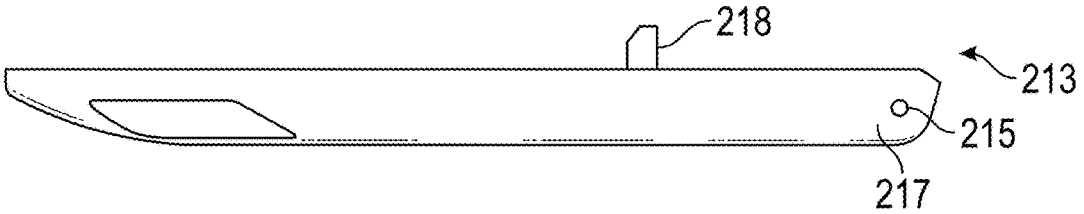
FIG. 20 is an isolated side view of the bottom half of the applicator of FIG. 16.

FIGS. 18-20, collectively represent an exploded view of applicator 200. FIG. 18 is an isolated side view of part of a thumb-operated latch 210 according to one embodiment for use in opening the applicator of FIG. 16. FIG. 19 is an isolated side view of the top half of the applicator 200. FIG. 20 is an isolated side view of the bottom half of the applicator 200. The front end opposite of the hinge may include a female half 250 of a docking system. The dock may be indents, bumps, magnets or any method to align the applicator to the inverter 100, to make simpler the mating of the two parts or the device may have no docking system at all.

Figure 63:
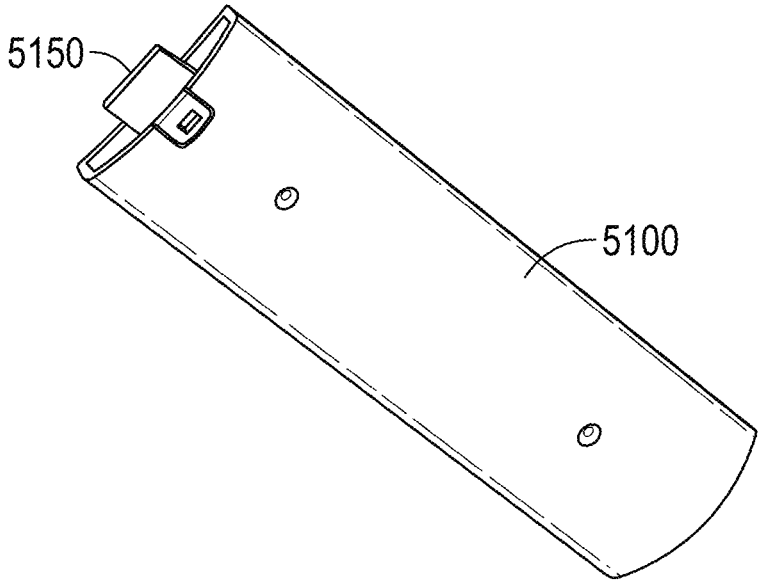
FIG. 63 is a perspective view of an inverterloader device according to another embodiment.
Figure 64:
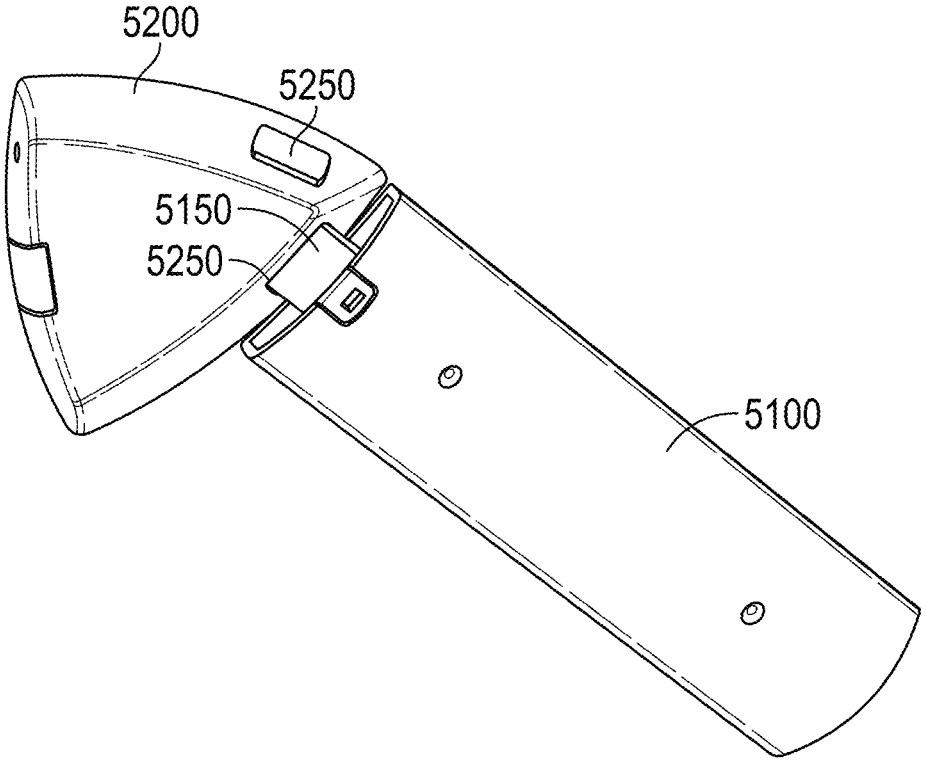
FIG. 64 is a perspective view of the inveter-loader device of FIG. 63 docked with the applicator of FIG. 21 according to an embodiment.

FIGS. 63 and 64 illustrate perspective views of an inveter-loader device 5100 and applicator 5200 using such a docketing system according to one embodiment. Applicator 5200 is similar to applicator 200. Inverter device 5100 is similar to inverter device 100 but has a male half 5150 of the docking system. Male half 5150 is located at the handle end supporting the flex band and is configured to plug into, or dock with, female half 5250 of the applicator. These docketing guides assist in aligning the applicator with the inveter-loader device to assist with correct loading and positioning of inverted false eyelash in the applicator. Both male half 5150 and female half 5250 have generally rectangular cross-sections. Male half 5150 extends from the inveterate device bottom housing. Male and female halves 5150 and 5250 may be other shapes that achieve docketing and alignment. In one embodiment, the male and female halves of the docking system can be magnetic.

Figure 21:
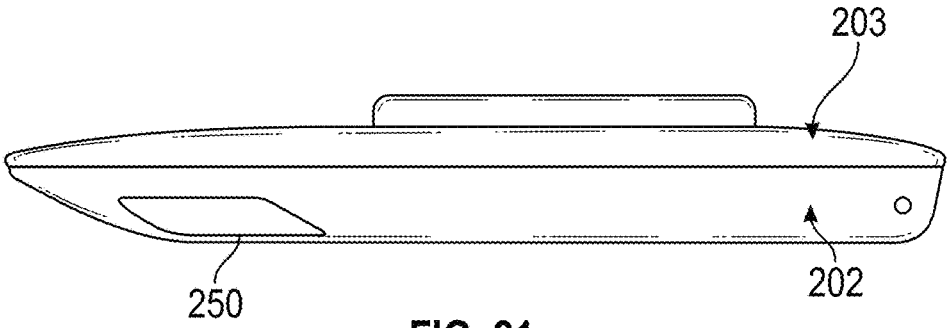
FIG. 21 is a side view of the applicator of FIG. 16 in a gripping position.

FIG. 21 is a side view of applicator 200 in closed configuration with claim members 202, 203 in a gripping position according to one example.

Figure 22:
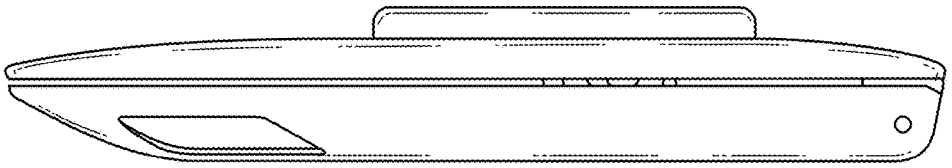
FIG. 22 is a side view of the applicator in FIG. 16 in a neutral position.
Figure 23:
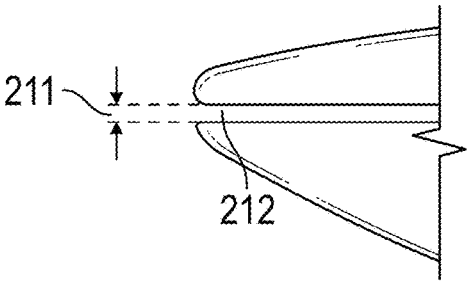
FIG. 23 is a partial detailed side view of the front of the applicator of FIG. 21 in neutral release mode.

FIG. 22 is a side view of applicator 200 in a neutral position according to one example. FIG. 23 is a detail side view of FIG. 22, of applicator 200 in neutral release mode. In a neutral position the two halves or clamp members 202, 203 are slightly ajar in a parallel manner to enable applicator 200 to gently hold false eyelash 50 in place, while allowing the false eylelash 50 to be released onto the eyelid as it is applied. Glue or other adhesive medium, pre-applied to the eyelid and/or false eyelash, holds the false eyelash onto the eyelid.

Figure 24A:
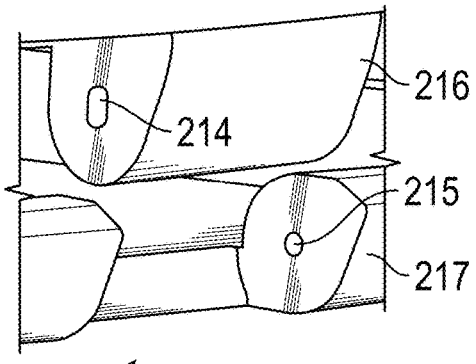
FIG. 24A is a partial enlarged perspective view of the hinge sections shown in FIGS. 19 and 20, showing oblong and circular axle holes of the hinge sections according to one embodiment.

In one embodiment, the applicator has a spacer mechanism which is operable to cause first and second clamp members 202, 203 to space apart from the substantially closed configuration to the neutral configuration by a predetermined distance 211 to form a gap 212 therebetween (FIG. 23). In one example, the spacer mechanism comprises an expandable hinge 213 and latch mechanism 210,218 which are operable to linearly space apart first and second members 202, 203 from one another to form gap 212. Referring in more detail to example embodiments of hinge 213, FIG. 24A is a partial perspective view of the hinge shown in FIGS. 19 and 20, showing oblong and circular axle holes 214, 215. Oblong hole 214 extends laterally through middle hinge section 216 of top clamping member 203. Circular axle receiving hole 215 extends laterally in hinge section 217 of bottom clamping member 202. Middle hinge section 216 is received in a corresponding gap formed in hinge section 217 of the bottom clamping member 202. Oblong and circular holes 214 and 217 align to receive the hinge axle. The oblong hinge axle hole allows the top member hinge section 216 to slide perpendicularly on the axle towards and away from the bottom clamp. Oblong hinge hole 214 together with the latch allows the top clamp member 203 (top half of the applicator) to travel up and down perpendicularly whilst remaining parallel with bottom clamp 202, allowing the clamp to both grip and then release. The tension is upward, thus making top and bottom clamp parallel.

Figure 24B:
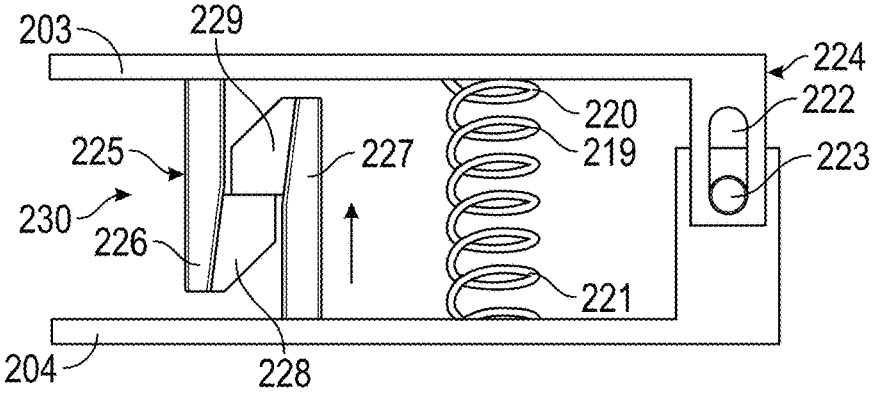
FIG. 24B is a partial enlarged side view showing an applicator spacer mechanism in more detail according to one embodiment.
Figure 24C:
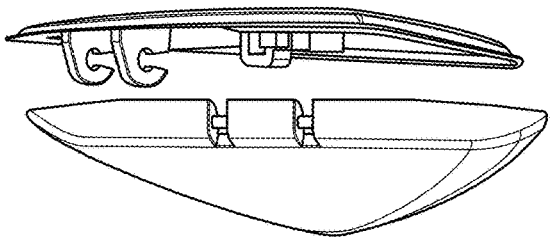
FIG. 24C is a rear perspective view of top and bottom applicator halves prior to being hinged together by a C-shaped hinge according to one embodiment.

In other embodiments, the oblong hinge axle hole need not be an entirely closed hole and is for example formed by one or more elongated C-shape hinge sections that snap into an axle that is already preformed in the bottom clamp hinge section. FIG. 24C shows such an exemplary hinge having a C-shaped section in the top clamping member according to one embodiment.

In other embodiments, the spacer mechanism may be different from that described above. For example, FIG. 24B, illustrates a partial side view of an applicator similar to applicator 200 but having a spacer mechanism 224 according to another embodiment. Spacer mechanism 230 includes spring 219 having one end 220 attached to the underside of top clamp member 203 and other end 220 attached to the underside of bottom clamp member 202. Spring 219 has a dimension and coil configuration that is selected so that manually squeezing of the clamp members together in the closed configuration compresses the spring whereas manually releasing the members from the closed configuration causes the spring to urge apart the clamp members into the neutral configuration.

Spacer mechanism 224 is configured to orientate the clamp members in parallel in the neutral configuration. Spacer mechanism 224 has a pin or axle receiving slot 222 extending downwardly and substantially perpendicular from underside of top clamp member 203. Pin or axle 223 is fixed in a lateral orientation on the underside of bottom clamp member 202. Pin or axle 223 is slidably retained in slot 222 and the longitudinal axis of pin or axle 223 extends laterally with respect to slot 222. Pin/axle 223 and slot 222 are slidable with respect to one another in a plane substantially perpendicular to the longitudinal plane of the members.

Latch mechanism 225 comprises a pair of releaseably engageable latches having arms 226 and 227, one arm 226 extending downwardly from underside of 203 and the other extending upwardly from member 202. Arms 226 and 227 include latching protrusions 228 and 227 at distal ends of the arms which are shaped to cooperate with one another so that the latches are releaseably engage able with one another. In an engaged configuration, the latches allow members 203, 204 to slide linearly up and down between neutral and closed configurations but prevent the members from opening apart further than the neutral configuration whereas in the disengaged configuration, the latches allow the members to swing apart into the open configuration.

When the spring pushes apart clamp members 202,203 from the closed to the neutral configuration relative movement between the clamps is constrained by the pin/axle and slot and latch to linear movement in the perpendicular plane causing the first and second members to space apart and stop in parallel in the neutral configuration. The members are stopped in the neutral configuration by the pin or axle abutting the end of slot 223 and/or the latch members. Slot 222 and pin/axle 223 can be provided by way of an expandable hinge, for example, as explained above, or may be a mechanism separate from any hinge. As shown in FIG. 24B, spring 219 is disposed between the latch mechanism and the slot. However, in other arrangements are envisaged for example in which the latch mechanism is disposed between the spring and the slot. In some embodiments, the latch mechanism can be omitted. In another example, the spring is omitted. In yet other embodiment, other types of spacer mechanisms may be used such as for example as provided by a shim clamp device integrated in the clamping members as will be described in more detail below.

In other embodiments, the aforementioned hinge sections, latch mechanisms, and/or spacer can be interchanged on the clamping members to achieve similar results.

In other embodiments, one or both clamp members may be of other shapes. which provide an clamping member outer side 206,207 which is convexly curved across the length for nesting with the inverted eyelash band of the inverted false eyelash that is being gripped by the clamping members. In some embodiments, the bottom clamp is thicker than the top clamp, to help push the persons natural lashes out of the way, so the glue, or other adhesive, doesn't accidentally touch the natural lashes. However, in other embodiments either clamping member can be any thickness to function as an applicator. Furthermore, both top and bottom clamps can be matching or different shapes that provide the necessary applicator o function.

Figure 28:
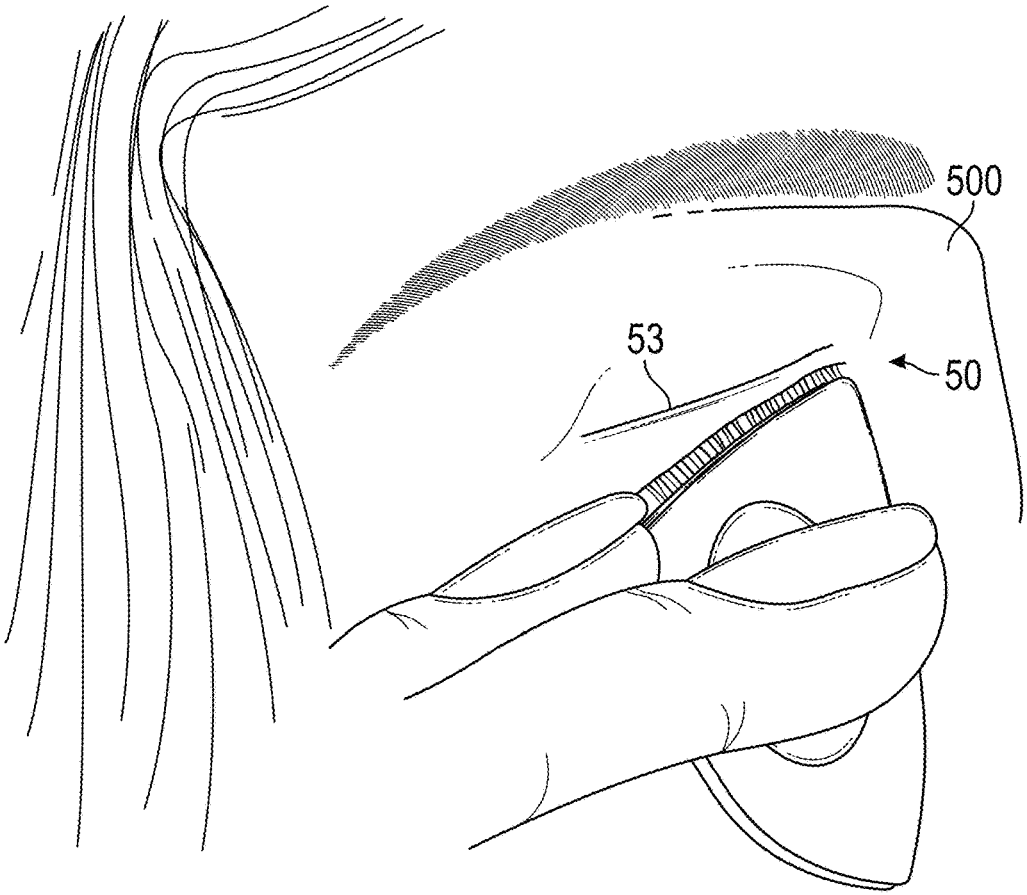
FIG. 28 shows the applicator applying the false eyelash onto the eyelid according to one embodiment.
Figure 29:
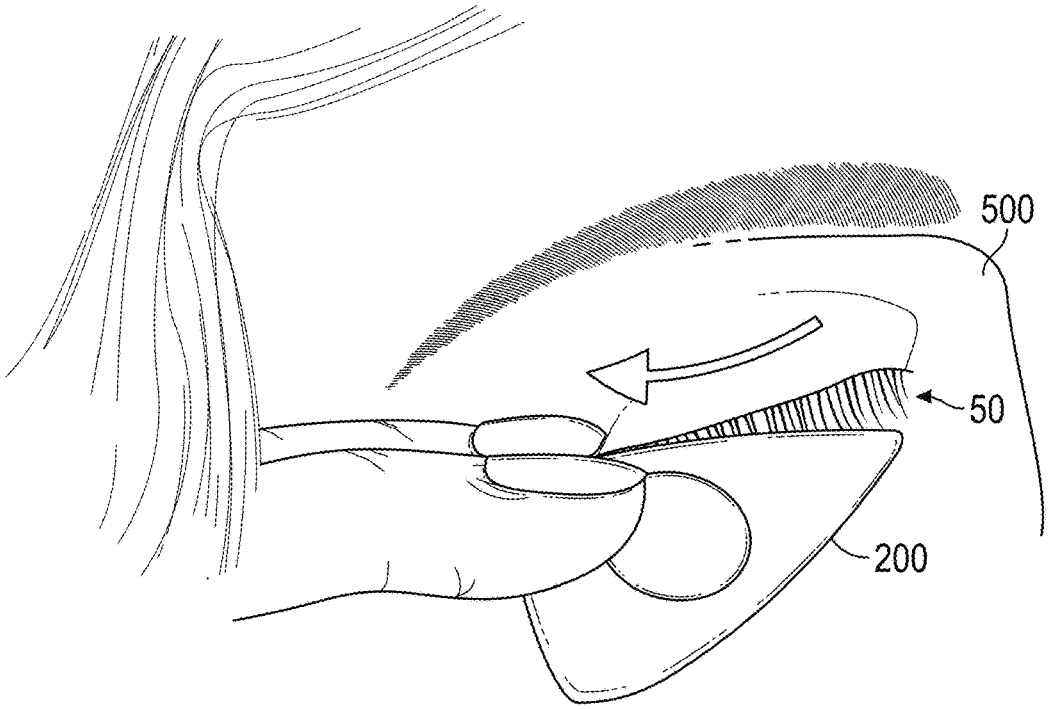
FIG. 29 shows the applicator of FIG. 27 continuing the application process as it rolls the inverted false eyelash onto and laterally across the eyelid.
Figure 30:
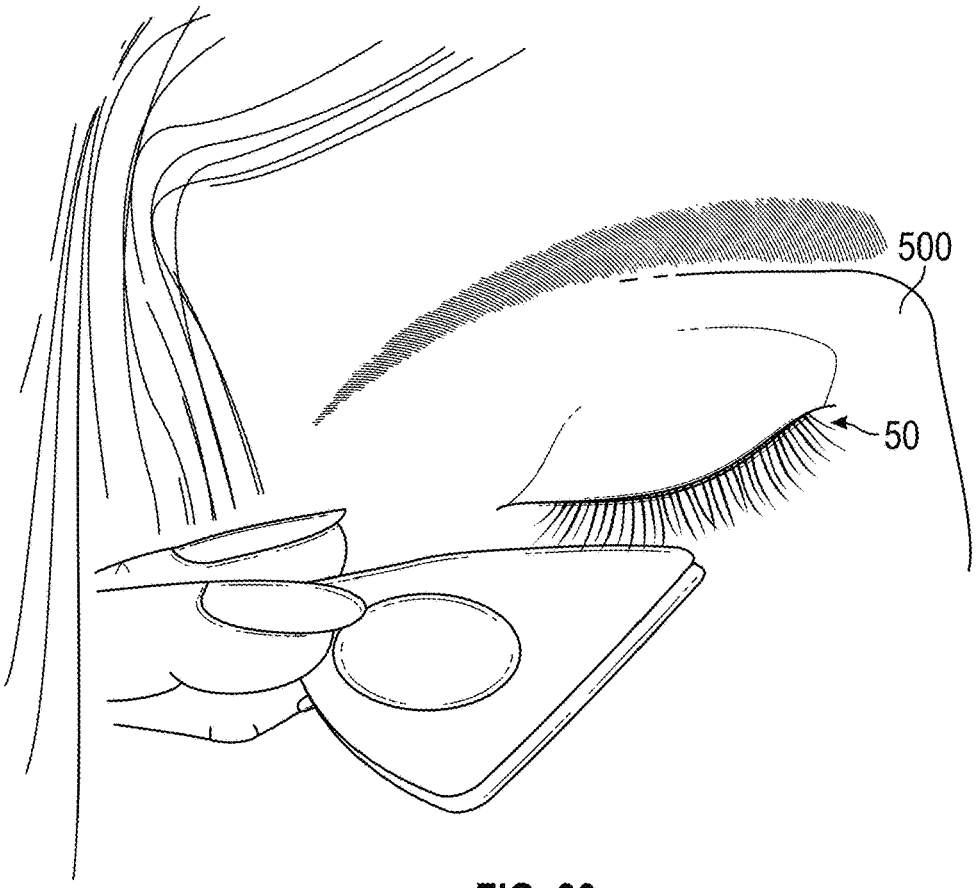
FIG. 30 shows the false eyelash application completed.

A method of operation of false eyelash applicator 200 according to one embodiment will now be described. Initially, applicator 200 is in an open configuration, as shown in FIG. 16. An inverted false eyelash 50 is loaded into applicator 200 in an inverted configuration (see for example FIG. 25). Clamp members 202, 203 are moved into the closed configuration to grip false lashes 52 of the loaded inverted false eyelash (see for example FIG. 27). Eyelash base 51 remains disposed outside the clamp in nested relation with the exterior surface of outer side 204 formed by clamp members 202,203 closing together. False eyelash base inner side 53 faces away from the clamp and has a substantially convex shape. Adhesive 20 is applied to inner side 53 (unless it has been pre-applied). By manipulation of the applicator latch 210, clamp members are brought into the neutral configuration. Inverted false eyelash 50 is now in a lengthwise roll on configuration in which eyelash base 50 is rollable lengthwise onto and laterally across the skin of an eyelid 500 and off the clamp, by manual manipulation of the applicator handle, as shown in FIGS. 27-30. FIG. 27 is a top view of false eyelash 50 in applicator 200 and now ready to be applied to eyelid 500. FIG. 28 shows applicator 200 applying the leading end of the false eyelash 50 band 51 onto eyelid 500. FIG. 29 shows applicator 200 continuing the false eyelash application process as it is rolls false eyelash 50 onto eyelid 500 and off the clamp. FIG. 30 shows the false eyelash application completed.

In other embodiments of applicator 200, first and second clamp members 202, 203 are shaped and arranged to support inner side 53 of eyelash base 51 being held outside of clamping member 202, 203 in a shape other than substantially convex. Eyelash base 51 may be supported in any configuration that allows supported inverted false eyelash 50 to be rollable lengthwise onto and laterally across the skin of eyelid 500 and off the clamp when applicator 200 is in the neutral configuration. By way of example, in one embodiment, first and second clamp members 202, 203 have outer sides 204 that are substantially straight lengthwise and arranged to hold the false eyelash in a substantially straight shape with eyelash band 51 disposed in a substantially flat configuration outside of clamping members 202,203.

Furthermore, in other embodiments, applicator 200 comprises a single support member rather than a clamp. The support member has a substantially convex outer side and supports, in nested relation, inverted false eyelash 50 in the same manner as outer side 204 of applicator 200. Inverted false eyelash can be releaseably mounted in a concave shape on the support member outer side using a suitable adhesive and with base inner side 53 facing away from the support outer side. The adhesive is chosen and applied in a manner so that the length of the eyelash 50 can still be easily rolled onto and laterally across skin of eyelid 500 and off the support member.

In some embodiments, inverter 100 has the dual function of being both an inverter and a loader for loading a eyelash 50, held on the flex band in the second configuration, into applicator 200. A regular false lash 50 is releaseably attached to the flex-band in the first configuration using the adhesive medium 20, for example as shown in FIGS. 3 and 5. The Flex-Band is then inserted into receiving member slot 101 of the inverter-loader 100. False eyelash 50 is then inverted with the inverter-loader 100 as shown in FIG. 14. Glue or other adhesive medium is applied to the inner side 53 false eyelash, if there is not pre-applied glue, or may be applied later. Inverted false eyelash 50 is then ready for loading into applicator 200 by manipulating inverter-loader device 100 and applicator 200.

In one embodiment, applicator 200 can be used to grip onto false eyelash 50 being held by the Flex-Band in the second configuration on inverter device 100. The two clamp shell halves or members 202, 203 are closed tightly around eyelashes 52. Once clamped onto false lashes 52, applicator 200 can be manipulated by the handle to pull false eyelash 50 off the Flex-Band.

Figure 25:
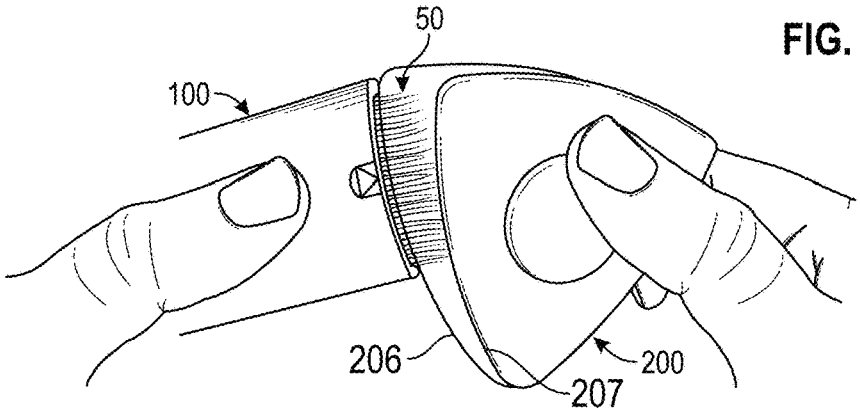
FIG. 25 is a top view of the inverted false eyelash releaseably supported on a Flex Band loaded in the receiving end of the inverter-loader, and the inverted false eyelash being partially inserted into the open eyelash applicator of FIG. 16 according to one embodiment.
Figure 26:
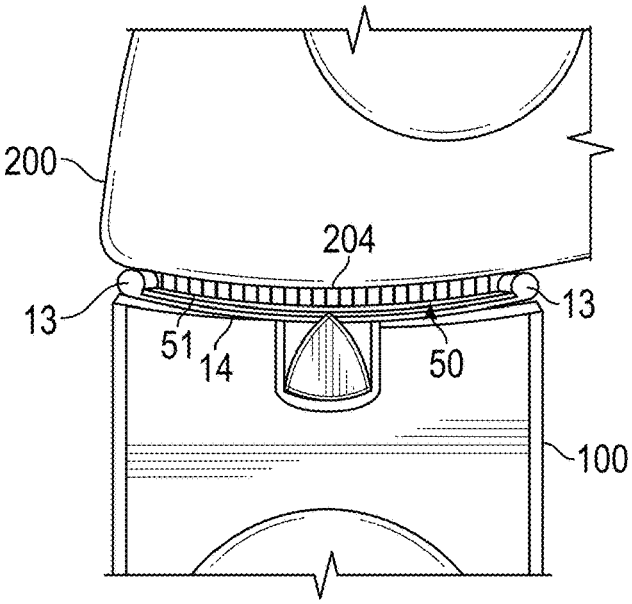
FIG. 26 is a top view detail of the false eyelash inverted and held by the closed lash applicator as result of closing the applicator halves shown in FIG. 25 according to one embodiment.
Figure 27:
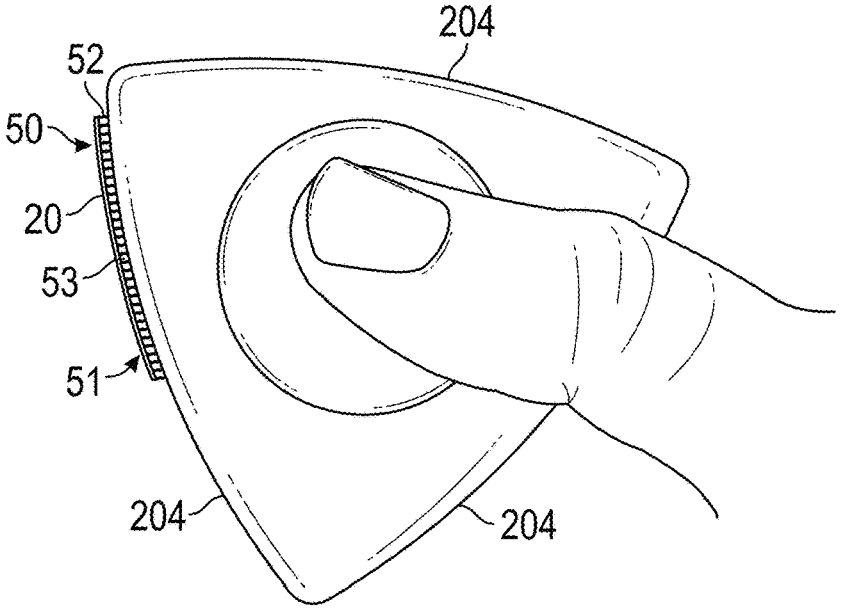
FIG. 27 is a partial top view of the inverted false eyelash in the applicator and orientated for applying to an eyelid according to one embodiment.

FIGS. 25 to 27 illustrate in more detail the process of loading inverted false eyelash 50, supported on the flex band, into applicator 200. using the inverter-loader device 100. FIG. 25 is a top view of inverted false eyelash 50 still loaded in the receiving end of the inverter-loader, being partially inserted into open applicator 200. The inverted false eyelash is orientated by manual manipulation of the inverter device so that eyelash band 51 is aligned lengthwise with the exterior of the bottom clamp curved outer side 206 and the lashes extend into the applicator between clamping members 202,203. Applicator 220 is closed onto inverted false eyelash 50. FIG. 26 is a top view detail of false eyelash 50 inverted and held by the closed lash applicator 200. Applicator clamp outer side 204 has a substantially convex shape generally complimenting the substantially concave shaped outer side 15 of flex band 14 being held in the second configuration by inverter-loader 100. This allows flex band 14 and applicator outer side 204 to be generally nested together with inverted false eyelash band 50 sandwiched therebetween as false eyelash 50, on the flex band 14, is loaded into applicator 200 (see FIG. 26). False lashes 52 are gripped by the applicator clamp. The lashes are gripped tightly to enable inverted false eyelash 50 to be pulled off the flex band and thereby removed from the inverter device whilst maintaining the false eyelash in the second configuration (inverted) (see FIGS. 26 & 27)

In one embodiment, the flex band opposing distal ends 13, are in the form of two cylindrical spacers, or other types of spacers, which extend from top to bottom of the flex band to align inverted false eyelash 50 on, and offset away from, applicator outer side 204, and keep inverted false eyelash 50 from being gripped too close to the eyelash band 51 (see FIG. 26). In one embodiment, the spacers are configured to space the aligned band 51 about 0.25-5 mm from the applicator outer side edge. In other embodiments, other spacing between aligned band 51 and applicator outer side edge may be adopted which achieves similar applicator functionality as described herein. If eyelash band 51 is too close or flush with applicator outer side edge, eyelash glue could get on both eyelash band 51 and the applicator's edge, effectively gluing false eyelash 50 to applicator 200. Additionally, offsetting false eyelash band 51 away from outer side 204, gives the user a clear view of the false lash's edge and thus where it will go on eyelid 500.

Applicator 200 is squeezed with fingers to grip the false eyelash, but another embodiment may employ a mechanical way of doing this.

After having removed inverted false eyelash 50 from the Flex-Band 10, as shown in FIG. 27, the inverted false eyelash is ready for glue 20 or other adhesive to be applied (if a glue strip is not pre-applied by the factory etc.). The inverted eyelash is then ready to be applied to the eyelid Applicator 200 is then allowed to default to its neutral position which continues to gently hold the false eyelash 50 in place (neutral position without the eyelash is shown in FIG. 22). Once the glued eyelash is adhered to eyelid 500, as eyelash 50 is rolled lengthways by maneuvering applicator 200 on and laterally across eyelid 500 from one corner of the eye to the other, false eyelash 50 flows out of applicator 200 and is held to eyelid 500 by glue.

In another embodiment of the method of operating the system, false eyelash 50 is pre-loaded at the factory.

In another example, applicator 200 may be a portable or disposable applicator that has been pre-loaded with inverted eyelash 50 for use by an end user when desired.

Figure 31:
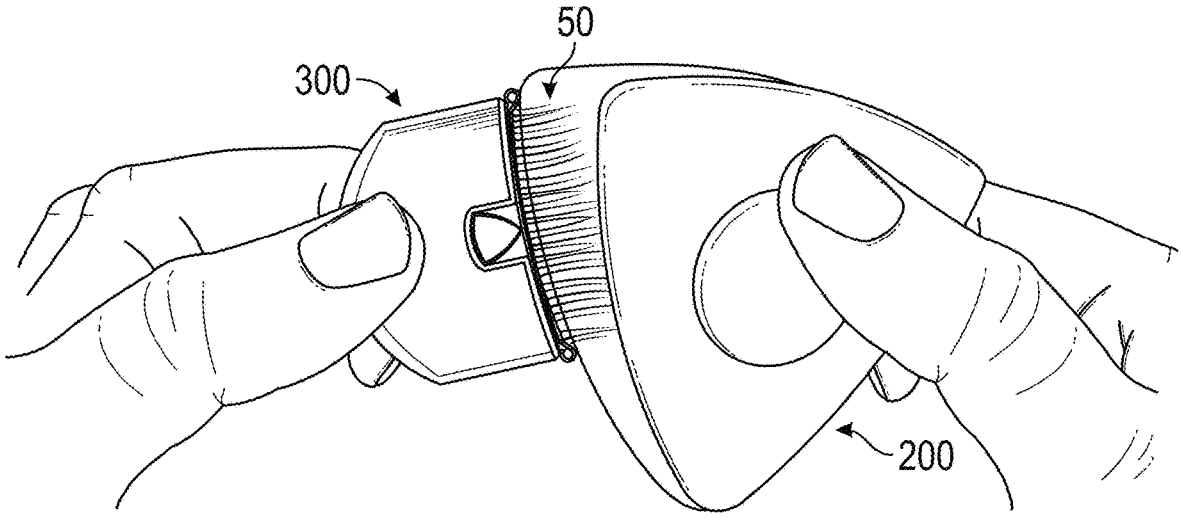
FIGS. 31 and 32 show the portable holder of FIG. 15 being used to maneuver the eyelash holder, and the inverted false eyelash carried thereon, into the applicator according to one embodiment.
Figure 32:
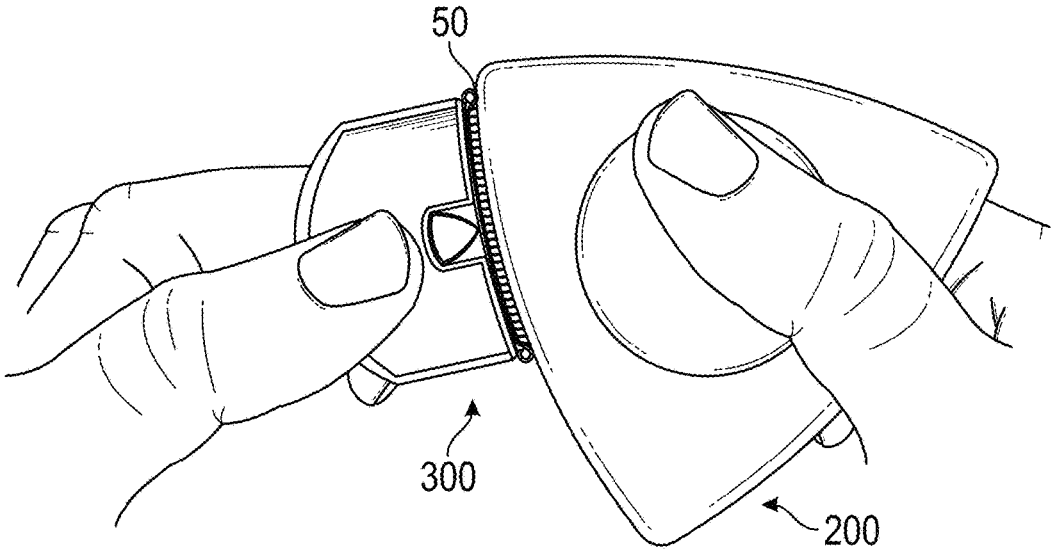

In yet other embodiments of a method of operating the system, portable holder 300 is utilized to grip an eyelash holder 10 on which eyelash 50 is held inverted on the flex band. Portable holder 300 is then manipulated to load inverted eyelash 50 into applicator 200 as shown in FIGS. 31 and 32. In yet another embodiment, eyelash holder 10, including eyelash 50 inverted on the flex band, is pre-mounted on portable holder 300 ready for loading into applicator 200.

In yet further embodiments, an eyelash holder is provided that is similar to eyelash holder 10 but includes a handle portion for manipulating the flex band to load the inverted false eyelash into the applicator. This removes the need to use a separate inverter device 100 or portable holder 300 to grip and handle eyelash holder 10. In one embodiment, eyelash holder 10, including the handle portion, is disposable and is provided with eyelash 50 already pre-inverted on the flex band. This allows an end user to simply load inverted false eyelash 50 on the flex band into applicator 200 without having to first invert the flex band or manipulate it using inverter loader 100 or portable holder 300.

Figure 33:
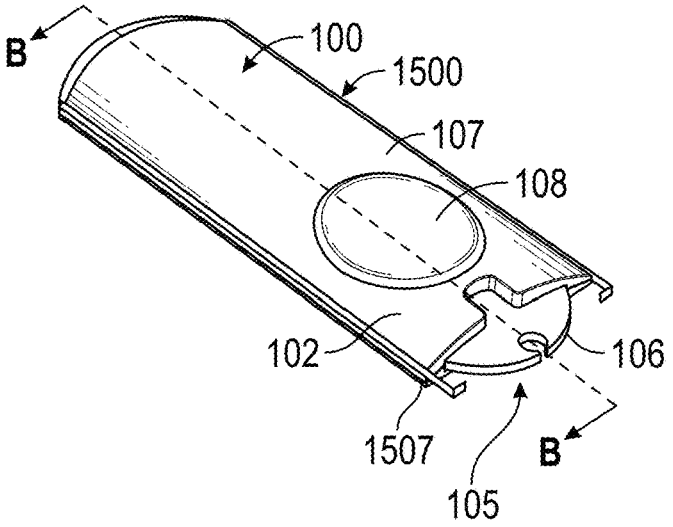
FIGS. 33 is a perspective view of an eyelash holder inverter device according to another embodiment.

Further embodiments of the inverter device will now be described. In some embodiments, the eyelash holder inverter device is configured to change eyelash holder from an inverted or near flat configuration to the first configuration. By way of example, FIG. 33 is a perspective view of an eyelash holder inverter device according to another embodiment. Inverter device 1500 of the embodiment of FIG. 33 is useful for applying a regular crescent shape false eyelash to an eyelash holder that has a default inverted or near flat configuration. The plastic or other material of the flex-band is molded in this default position. Inverter device 1500 comprises inverter device 100 described above with reference to FIGS. 7 and 8 with the addition of a stopper frame 1507.

Figure 34:
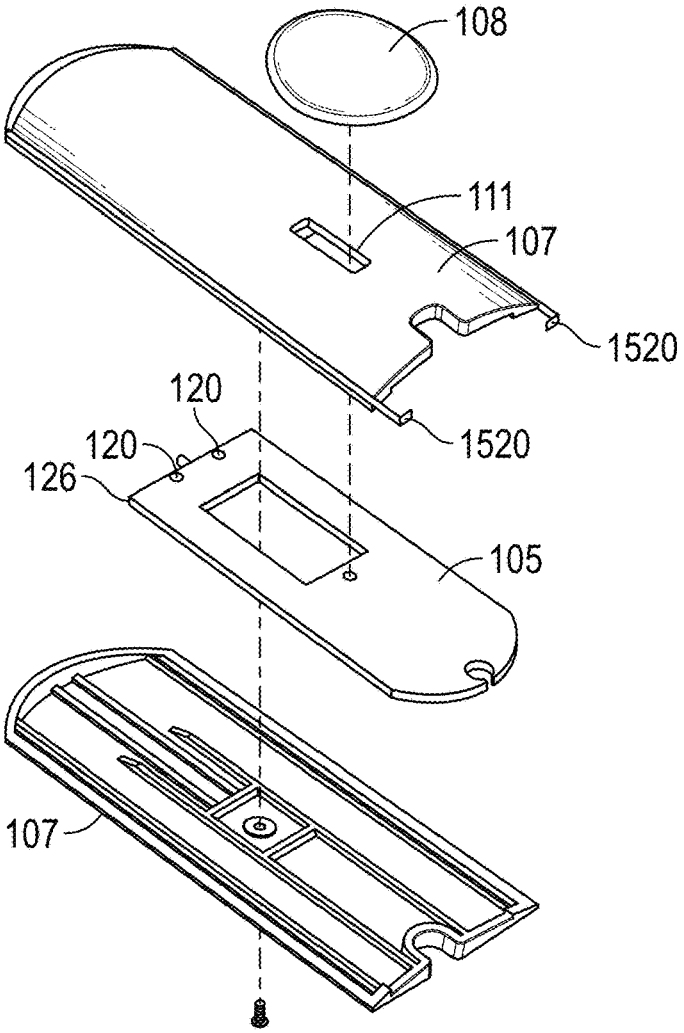
FIG. 34 is an exploded view of the device of FIG. 33.
Figure 35:
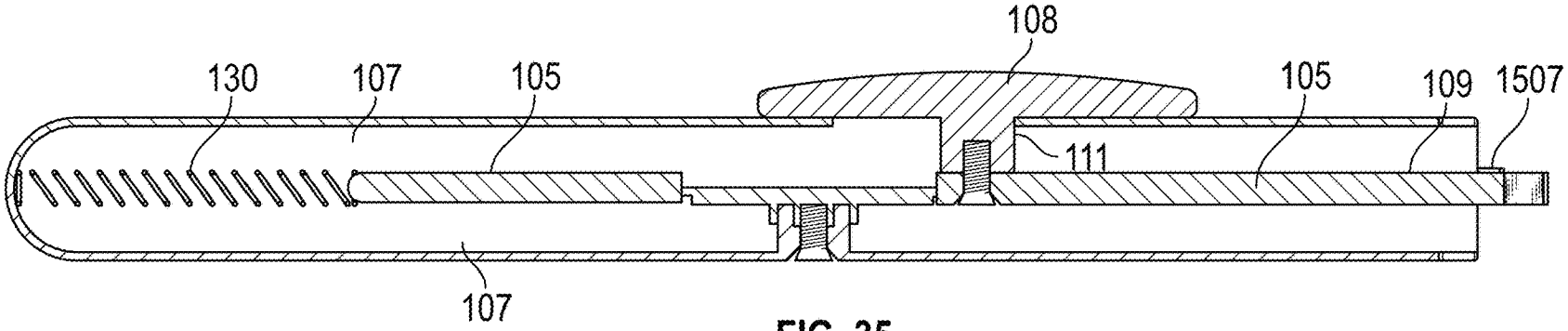
FIG. 35 is a longitudinal sectional view taken along the central longitudinal axis B of the device indicated in FIG. 33.

Turning in more detail to inverter device 100, handle housing 107 comprises two halves enclosing planar slider receiving member 105 (see exploded view in FIG. 34). As already mentioned above, in other embodiments, handle housing 107, receiving member 105 and cavity 109 may be of other shapes and arrangements that enable the receiver member and inverter mechanism to perform the desired function. Thumb button 108 is attached to the receiving member 105 via housing longitudinal opening 111 which is arranged to allow the button to move back and forth with receiving member 105 along the longitudinal axis of the device. The receiving member is slidably actuatable between retracted and extended positions single handedly by a user holding the handle housing in one hand and, with their thumb placed on the thumb button, moving the receiving member back and forth.

Spring 130 is disposed longitudinally inside housing 107 between the housing rear end and the rear end of receiving member 105. Spring 130 is configured to bias receiving member 105 when receiving member is moved to the extended position and to pull receiving member 105 back into a retracted position when the thumb button is released. Stoppers 120 are arranged at slide member distal end 126 opposite the end at which is integrated receiving member 105. Stoppers 120 are protrusions arranged and shaped to extend generally perpendicular to the longitudinal plane of the slider such that the stoppers abut the interior housing to prevent over retraction or extension of the slider.

Frame 1507 comprises a pair of arms which extend along opposite exterior longitudinal sides of the housing and out from the cavity end of the handling housing. The frame arms extending outwardly from the housing cavity end have distal ends 1520 that are spaced from the cavity end 109 (see FIG. 34). Frame arm distal ends 1520 are configured to retain in a fixed position, with respect to the handle housing 107, flex band opposite ends 13 when flex-band 14 is loaded in the inverter device with the receiving member retracted. In the embodiment of FIG. 33, the frame distal ends 1520 are generally L shaped and turned inwardly towards each other in the longitudinal plane of the housing so that the frame arms 1507 retain the opposite distal ends of the eyelash holder in a fixed position. However, in other embodiments, frame ends 1520 may be other shapes such as annular or other angular shapes or other shapes that retain flex band ends 13. Furthermore, other types of retaining means other than frame arms may be employed to provide the same function of retaining flex band opposite ends. Other embodiments of the inverter device and/or eyelash holder described hereinbefore may be adopted which allow the shape of the flex-band or other support member of the eyelash holder to be changed for application of the false eyelash and subsequent inversion.

Figure 36:
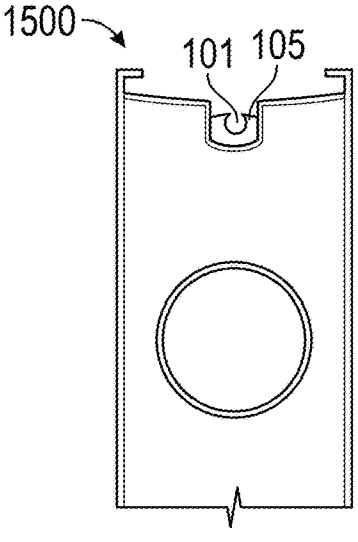
FIGS. 36 is a top plan view of the eyelash holder inverter device of FIG. 33 unloaded and retracted.

FIGS. 36 to 40 illustrate a method of operating the inverter device 1500 for providing the false eyelash on a flex band that naturally assumes an inverted or near flat configuration As shown in FIGS. 36, eyelash holder inverter device 1500 is initially in an unloaded and retracted configuration in which receiving member 105 is fully retracted into cavity 109 leaving the receiving member locating hole 101 accessible from the exterior. Blank false eyelash holder 1510 is similar to eyelash holder 10 with the exception that the flex-band 1514 has an inverted or near flat default configuration. Flex-band 1514 is loaded into the retracted receiving member 105 by inserting the bottom end of the flex-band alignment post head 12 into the receiving member locating hole. Flex band opposite ends 13 are held by frame arms 1507 (see FIG. 37).When so loaded, opposite ends 13 are retained in a fixed position at or adjacent the handle housing end by frame arms 1507 whereas the rest of the flex-band is free to flex. Actuating inverter device 1500 by sliding the thumb button forward causes receiving member 105 to slide out of handle cavity 109 to the extended position. As member 105 extends, receiving member 105 pushes the center of flex-band 1514 causing the flex-band to flex from the inverted second configuration to the first configuration in which the flex band is substantially convex shaped (see FIGS. 37 in conjunction with FIG. 38). With flex-band 1514 in the convex shape (regular crescent moon shape), a regular crescent false eyelash 50 is then applied to the flex-band outer side. False eyelash 50 is applied in the manner already described hereinabove with reference to other embodiments, such as for example using an adhesive medium to adhere the inner side of the false eyelash band to the outer side of the flex band (see FIG. 39).

Figure 40:
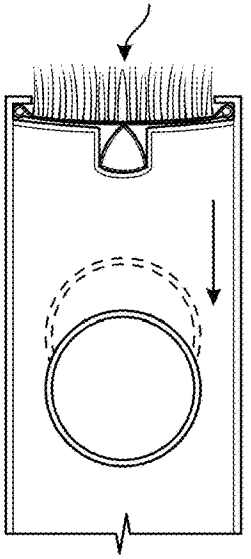
FIG. 40 is a top plan view of the loaded eyelash holder inverter device in a retracted configuration in which the eyelash holder has been changed back to the second configuration as a result of the inverter device retracting.
Figure 39:
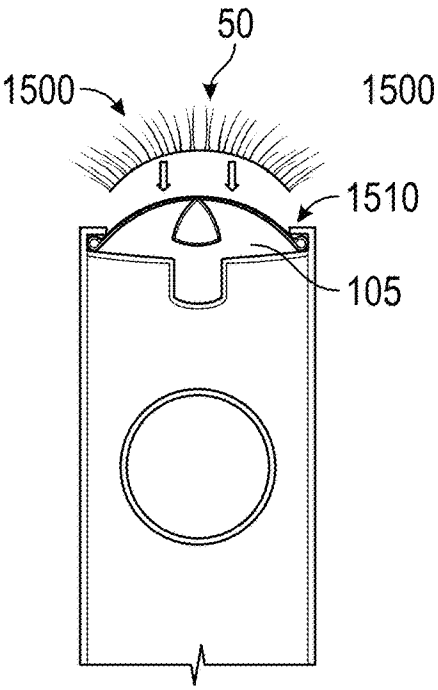
FIG. 39 a top plan view of the device as shown in FIG. 38 and indicating application of the crescent shaped false eyelash to the eyelash holder held in the first configuration by the device.
Figure 38:
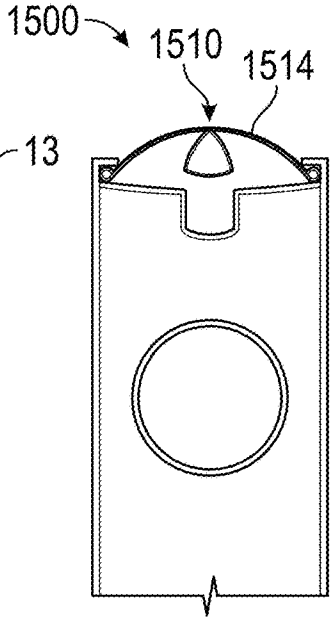
FIG. 38 is a top plan view of the loaded eyelash holder inverter device in an extended configuration in which the eyelash holder has been changed from the second configuration (inverted or near flat) to the first configuration (convex) according to one embodiment.
Figure 37:
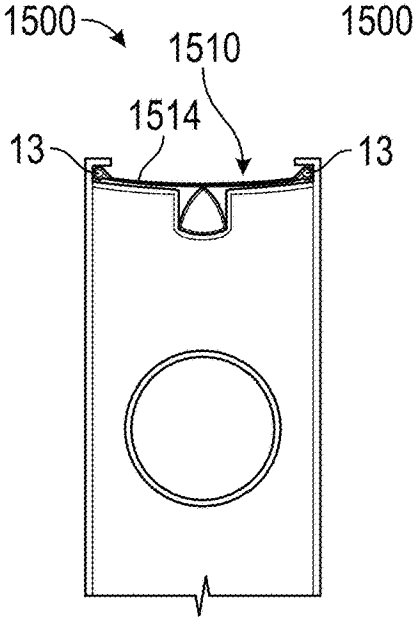
FIGS. 37 is a top plan view of the eyelash holder inverter device of FIG. 36 loaded with an naturally inverted eyelash holder according to one embodiment.
Figure 42:
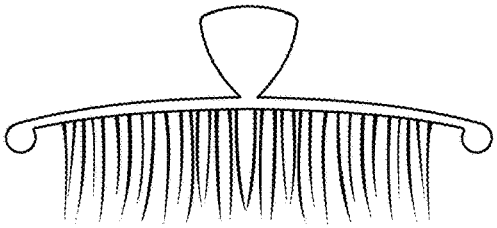
FIG. 42 is a top plan view of the false eyelash holder, and false eyelash thereon in the default second configuration, according to one embodiment.
Figure 43:
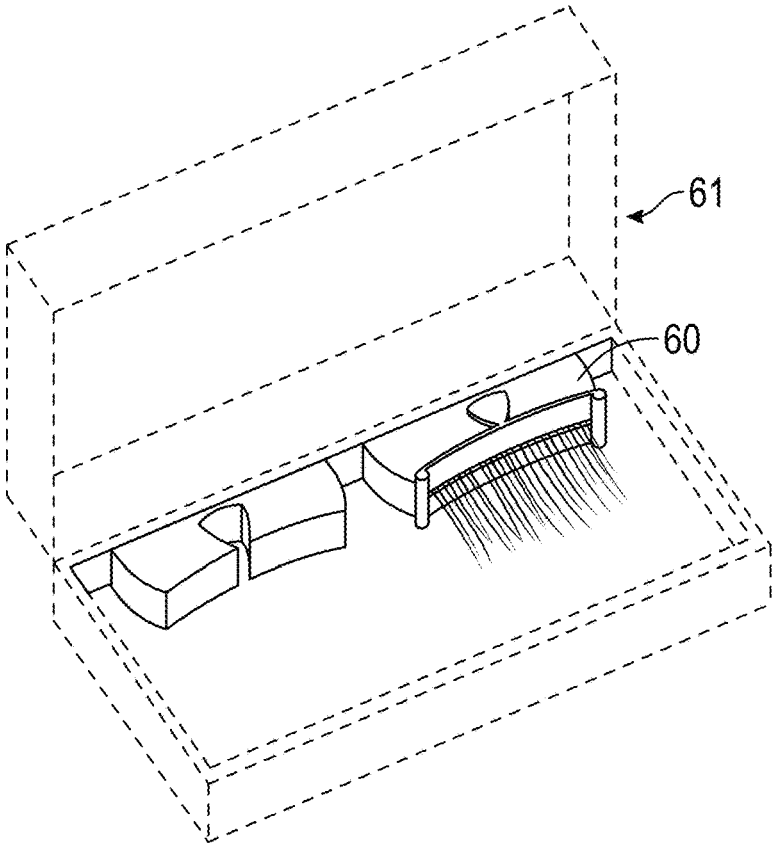
FIGS. 43 is a perspective view of the inverted eyelash holder, and inverted false eyelash carried thereon, held in a tray holder locatable in a box according to one embodiment.

Applying the regular crescent shaped false eyelash 50 when the flex-band 1514 is in the convex shape is advantageous in factory manufacturing because the operator of the device can more easily apply a regular looking false eyelash 50 in the regular shape to flex-band 1514 and determine if the applied false eyelash on the eyelash holder is consumer ready. Once false eyelash 50 has been so applied, receiving member 105 is retracted pulling the flex-band towards handle 107 and causing flex-band 1514 to revert to near flat or inverted configuration (second configuration) thereby inverting false eyelash 50 applied thereto, as indicated in FIG. 40. Thereafter, the inverted flex-band 1514 carrying false eyelash 50 thereon, is removed from inverter device 1500 ready for use or sale to the end user. Since flex-band 1514 naturally defaults to the near-flat or inverted configuration, flex-band 1514, and false eyelash 50 carried thereon, remain in the near-flat or inverted configuration after removal from the inverter device. FIG. 42 is a top plan view of inverted flex band 1514 together with inverted false eyelash 50 carried thereon according to one embodiment. The assembly of FIG. 42 can be loaded into a tray holder 60 for storage in a box 61 or other unit (See FIG. 43).

In some other embodiments, frame arms 1504 are omitted, and flex-band opposite ends of the eyelash holder are held in a fixed position instead by a person operating the inverter device 100 using their fingers and/or operating an external tool (such as pliers) as the inverter device is actuated.

As made apparent with reference to the applicator embodiments described herein, since flex-band 1514 defaults to the second configuration and flash eyelash 50 has already been pre-assembled on flex-band 1514 in the second configuration, a consumer or other user wishing to apply the false eyelash using applicator 200 can simply load the pre-inverted false eyelash, held on the flex-band, into applicator 200 without having to use the inverter device to invert or maintain flex-band 1514 in the inverted position. In some embodiments, inverted eyelash 50 can be loaded by manipulating flex-band 1514 directly by hand even without the assistance of any loading device.

As with previous described embodiments of inverter device 100, operation of inverter device 1500 may be partly or entirely automatic instead of hand operated. Also, alternative device configurations may be adopted to provide the same general function of device 1500. Inverter device configurations and methods of operation may depend on the type of default configuration of the eyelash holder. For example, whilst inverter device embodiment 1500 has been described with reference to adjusting the shape of a flex-band having a default second configuration (inverted shape), Inverter device 1500 can alternatively or additionally be used in conjunction with a flex-band having a default first configuration. In this case, inverter device would be initially loaded in the extended position (see FIG. 39 as an example of the extended position) and inversion would be caused by retracting the receiving member 105 from the extended position to the retracted position.

In some embodiments, the inverter device is configured such that the flex-band is adjustable between the first and second configurations or other desired shapes by holding flex-band opposite ends in a fixed position and the flex-band center being pushed or pulled.

Figure 41:
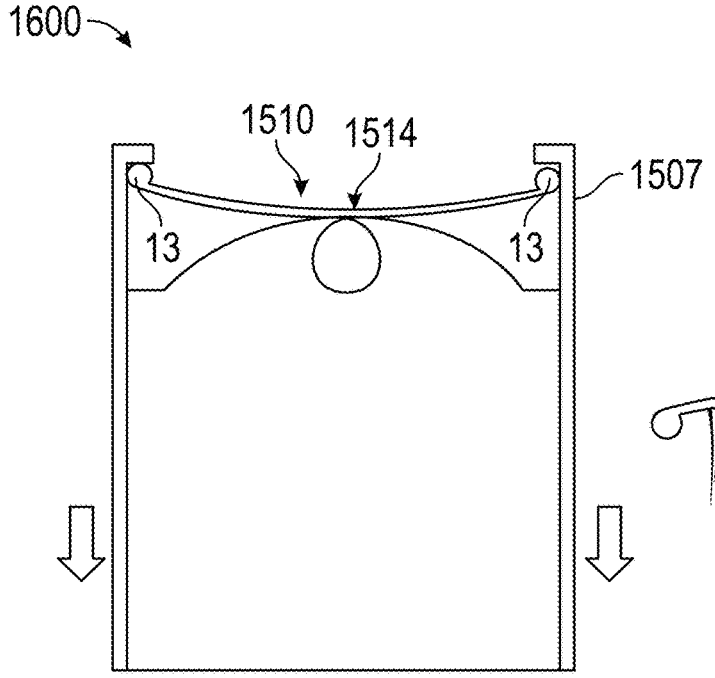
FIG. 41 is a top plan view of a eyelash holder inverter device according an alternative embodiment.

In some other embodiments, the inverter device is configured such that the flex-band is adjustable between the first and second configurations or other desired shapes by pushing or pulling flex-band opposite ends whilst the flex band center is held in a fixed position to achieve the desired change. By way of example, in an alternative embodiment of the inverter device, operation of the inverter device causes flex-band opposite ends to be pulled towards the handle casing whilst the receiving member holds the flex band center in a fixed position so as to change the shape of the flex band from near-flat inverted to convex. FIG. 41 illustrates a plan view of such an inveter device 1600. In this device, the flex-band 1514 is loaded in the inverter receiving member which is held in a fixed position beyond the handle end. Frame arms 1507 are slidably mounted in the longitudinal plane of the handle and retractable by sliding the arms back to pull flex-band opposite ends 13 towards the housing. As the center of the flex-band remains in a fixed position on the handle housing, pulling opposite ends 13 causes flex band 1514 to flex from the near-flat or inverted (second configuration) to the convex shape (first configuration). In some other embodiments, frame arms 1507 are omitted, and flex-band opposite ends 13 are moved instead by a person operating the inverter device using their fingers and/or operating an external tool (such as pliers) to move if the eyelash holder opposite ends.

As will be explained in more detail below, in some embodiments, the Applicator aspect of the present technology can have other designs to those described with reference to FIGS. 16-31 but still achieve the general applicator function of receiving a an inverted false eyelash 50 and rollably supporting the inverted false eyelash in a lengthwise roll on configuration for rolling, by manipulation of the applicator, the false eyelash lengthwise laterally over an eyelid and off the support. The pair of clamping members may use a variety of methods to assist in holding them together. As will be explained in more detail below with reference to particular exemplary embodiment, any type of hinge including a living hinge may be used to hold them together. Alternatively or additionally, one or more posts and post receiving holes may be used to hold the clamping members together. In some embodiments, one or more spaced apart pins or posts are employed for self aligning the clamp members with or without a hinge. In yet other embodiments, a clip, on the side wall of the members can be used. The clip can be any shape, i.e. square, rectangular, triangular etc. and may also have a finger grip. The clip can rely on the torsion of the clip material to clip the clamping members together. Alternatively or additionally the clip may include a spring mechanism or some other clipping mechanism to clip the clamp members together. For example, the clip mechanism that us used in pants and other clothing hangers can be employed. In yet other embodiments, the clamp members are hingless and manipulation of the members is entirely by hand. In some embodiments, a button clamp, such as a shim clamp, is adopted on the applicator for pushing forward to squeeze the pair of clamping members together and pull back to release. In yet other embodiments, the applicator is a singe unitary structure rather than a pair of clamping members.

Figure 44:
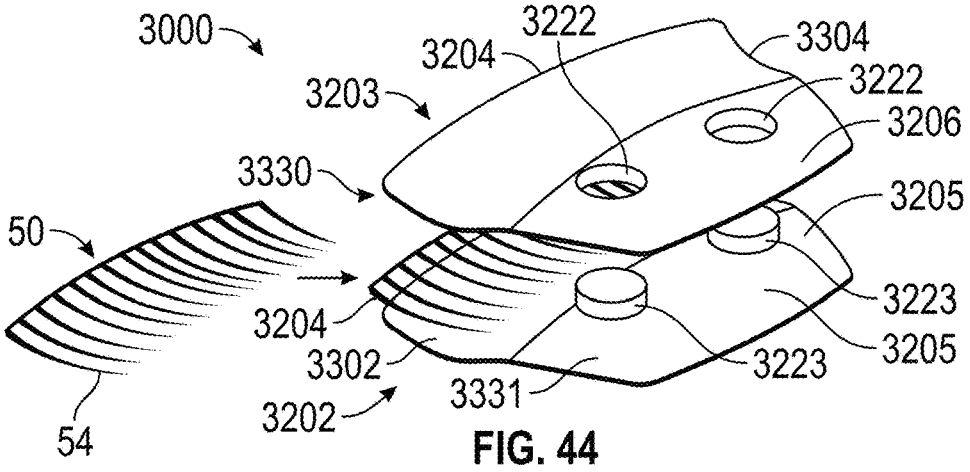
FIG. 44 is a perspective view of an applicator in an open configuration according to another embodiment.

Reference will now be made in more detail to some of the alternative embodiments of the applicator. In one embodiment, the Applicator is hingeless and the clamping members are retainable in the closed configuration by a clip. FIGS. 44 to 47 illustrate such a hingless Applicator according to an embodiment. Applicator 3000 has bottom and top clamping members 3202 and 3203. Each clamping member 3202, 3203 has an outer support side 3204 which is substantially convex curved along its length for supporting false eyelash 50 in a inverted or near flat configuration. As shown in FIG. 44, when false eyelash 50 is in the concave shape (in the inverted or near flat configuration), lashes 54 curl in a concave manner. Bottom clamping member 3202 has an upper face 3331 comprising a front lash receiving groove or channel 3302 and a rear handle portion 3205. Lash receiving groove 3302 curves along convex outer side 3204 and has concave cross-section. When inverted false 50 eyelash is loaded onto the clamping member 3202, individual lashes 52 are received in lash receiving groove 3302 and the shape and arrangement of lashes 52 on lash band 51 is maintained substantially as they were for the unloaded inverted eyelash. Clamping member 3203 has a lash receiving portion 3304 with a cross section and shape corresponding to the front lash receiving groove such that, when top clamping member 3203 is aligned above bottom clamping member 3202 and the clamps are retained together in the closed configuration with the members one above the other in alignment, clamping members 3202, 3203 are nested together with lash receiving portion 3304 nested in lash receiving groove 3302. A pair of spaced apart alignment holes 3222 are arranged on top clamp handle portion 3206. A pair of corresponding alignment posts 3223 extending upwardly from upper side of bottom clamp handle portion 3205 are configured to slidably engage with corresponding alignment holes 3222 and align clamping members 3202, 3203 as they are pressed together. Clamping members 3202, 3203 are slidable in a plane perpendicular to the longitudinal plane of the clamping members and remain in alignment as the clamps slide apart and together.

Alignment posts 3223 and holes 3222 have circular cross sections but in other embodiments may be of other cross-sections such as square, rectangular and so on. In some embodiments more than two alignment posts and corresponding holes may be provided. In other embodiments, the position of the alignment posts and corresponding holes on the clamping members may be different and any configuration/position of alignment posts and holes is envisaged that performs the function of aligning the clamping members as they are pressed together. By way of example, in one embodiment, the arrangement of one alignment hole and corresponding post can be reversed on the clamping members such that the alignment hole is formed on the bottom clamp and the post on the top clamp. In some embodiments, a single alignment post and corresponding hole may be used that has an oval, square, rectangular or other cross-section that maintains alignment of the members.

Figure 45:
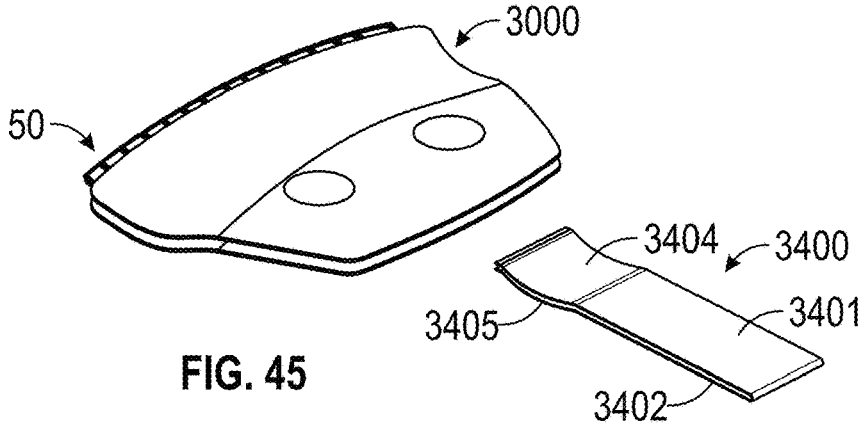
FIG. 45 is a perspective view of the applicator of FIG. 44 in a partially closed configuration and a clip for fastening the clamping members together according to one embodiment.
Figure 46:
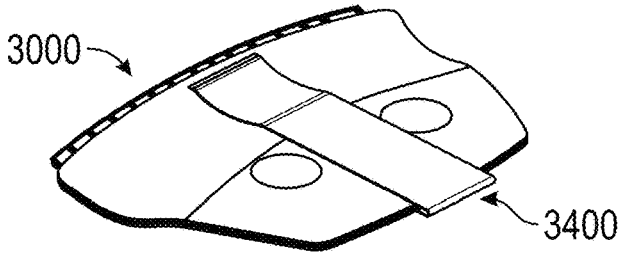
FIG. 46 is a perspective view of the applicator and the clip holding the clamping members together in a closed configuration according to one embodiment.
Figure 47:
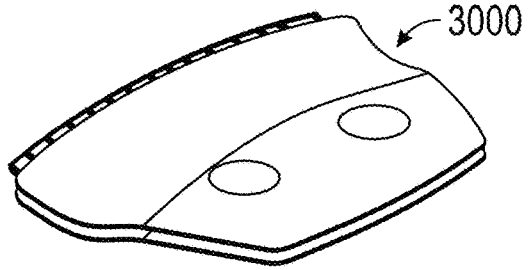
FIG. 47 is a perspective view of the applicator in a neutral configuration and the clip removed according to one embodiment.

As indicated in FIG. 45, applicator 3000 has a clip 3400 which is configured to releaseably retain clamping members 3203, 3202 in the closed configuration. Clip 3400 has a pair of generally planar tongues 3401 and 3402 which are configured to grip and press the clamps together. When clamping members 3203,3202 in the closed configuration are inserted between the pair of tongues 3401, 3402, the tongues will be forced apart and cause torsion in the bend of the tongue to grip and press the clamps together. Tongues 3401, 3402 have front regions 3404, 3403 with concave cross-sections corresponding to those of the front groove/portion 3304, 3204. In this manner, when closed clamping members 3203, 3202 are retained together by the clip, tongue front regions 3404, 3403 nest with the corresponding clamping member groove/portion 3304, 3302. This helps to press together top and bottom clamp front regions.

In some embodiments, applicator 3000 is disposable. The inverted false eyelash 50 is loaded into the applicator and the clamping members clipped together in the closed configuration ready for shipping in storage. The false eyelash 50 may be regular false eyelash 50 that has been inverted by a device described herein or may be a false eyelash that is manufactured in a way that enables the false eyelash to be easily placed in the inverted position by hand. Thereafter, the adhesive medium can be applied to the loaded eyelash (if not before loading). Removing the clip allows the applicator to go into the neutral configuration ready for application onto the eyelid.

In FIG. 45, clip tongues 3401, 3402 are generally elongated planar members, however, other shaped tongues or members are envisaged that are capable of pressing the clamping members together. The clips is made from any suitable clip material, such as steel or plastic. In some embodiments, the curved front regions of the tongues are omitted (see for example clip 3450 of FIG. 49).

Figure 48:
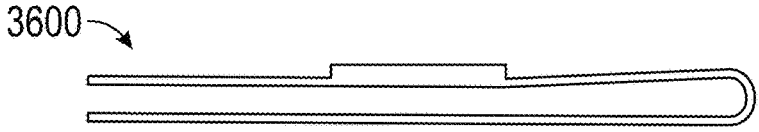
FIG. 48 illustrates a side view of a applicator according to yet another embodiment.
Figure 49:
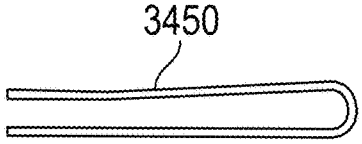
FIG. 49 illustrates a longitudinal sectional view of an applicator according to yet another embodiment.
Figure 49:
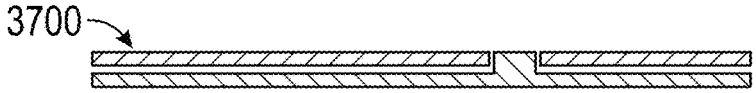
Figure 50:
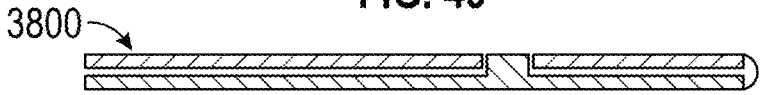
FIG. 50 illustrates a longitudinal sectional view of an applicator according to yet another embodiment.
Figure 51:
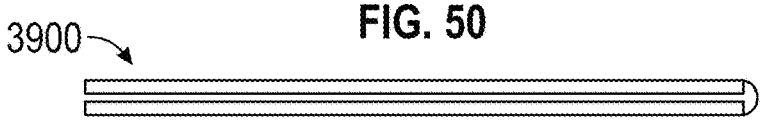
FIG. 51 illustrates a side view of an applicator according to yet another embodiment.
Figure 52:
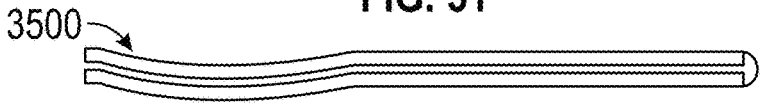
FIG. 52 illustrates a side view of an applicator according to yet another embodiment.

In some other embodiments, the top and bottom clamp groove and/or curved portions are omitted and the front regions are flat. FIG. 49 is a longitudinal cross sectional view of an applicator 3700 according to another embodiment in which the clamping members including the front regions are planar. As shown in FIG. 49, a clip 3450 is provided for squeezing the clamp members together and then releasing them as necessary. Additionally or alternatively, a hinge may be adopted in conjunction with the alignment posts and holes. FIG. 50 illustrates a cross-sectional side view of an applicator 3800 including the alignment posts and holes and a living hinge (a hinge formed from a continuous material joining the ends of the clamping members together). FIG. 51 is side view of an example embodiment of an applicator 3900 which is similar to the applicator of FIG. 50 but without alignment posts and holes. FIG. 48 is a side view an example embodiment of an applicator 3600 similar to the applicator of FIG. 51 but with a finger grip on the upper clamping member. FIG. 52 is a side view of an example embodiment of an applicator 3500 which is similar to the applicator of FIG. 51 but includes a concave receiving groove/portion on the clamping members.

Figure 53:
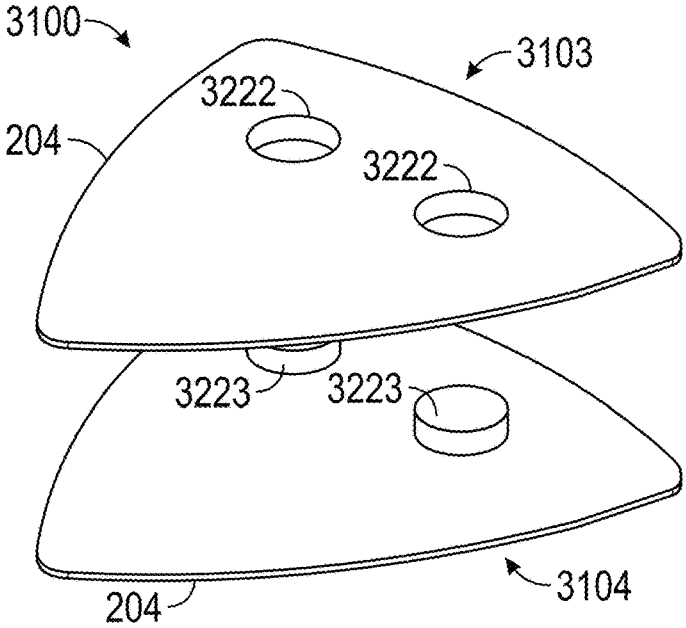
FIG. 53 illustrates a perspective view of an applicator according to yet another embodiment.

FIG. 53 illustrates a perspective view of the an applicator 3100 according to yet another embodiment. Applicator 3100 is a hingeless configuration and has three outer sides 204 for gripping and releasing the inverted or near flat false eyelash. Alignment posts 3223 and corresponding holes 3222 are respectively provided on bottom and top clamping members 3104 and 3103 for manually holding the clamping members together in alignment during operation of the applicator.

Figure 54A:
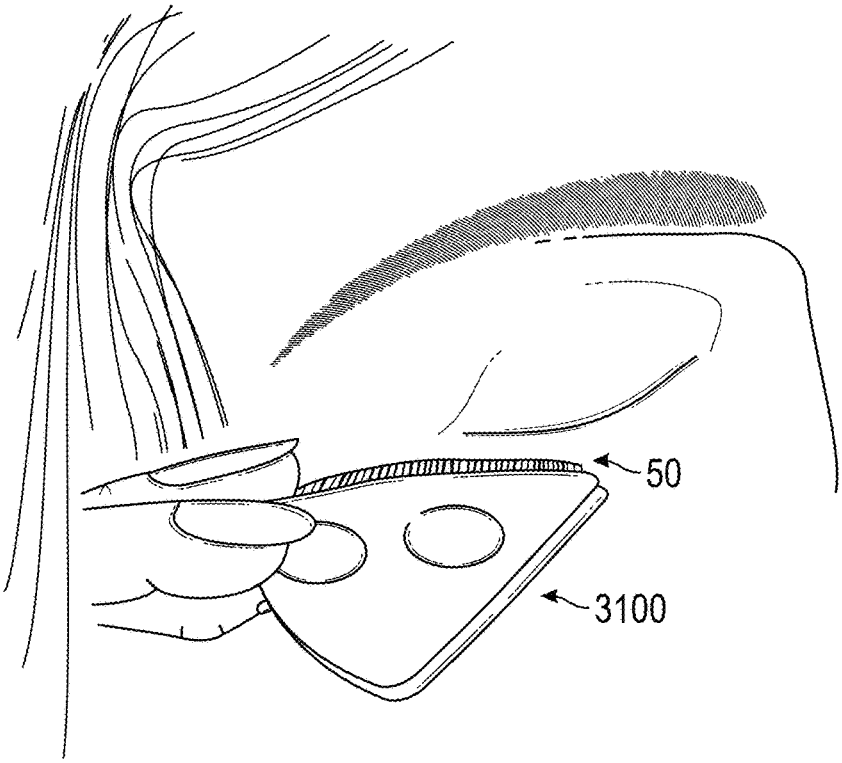
FIGS. 54A to 54D illustrate views of the applicator of FIG. 53 being using used to apply an inverted false eyelash loaded thereon to the eyelid of a person according to an embodiment.
Figure 54B:
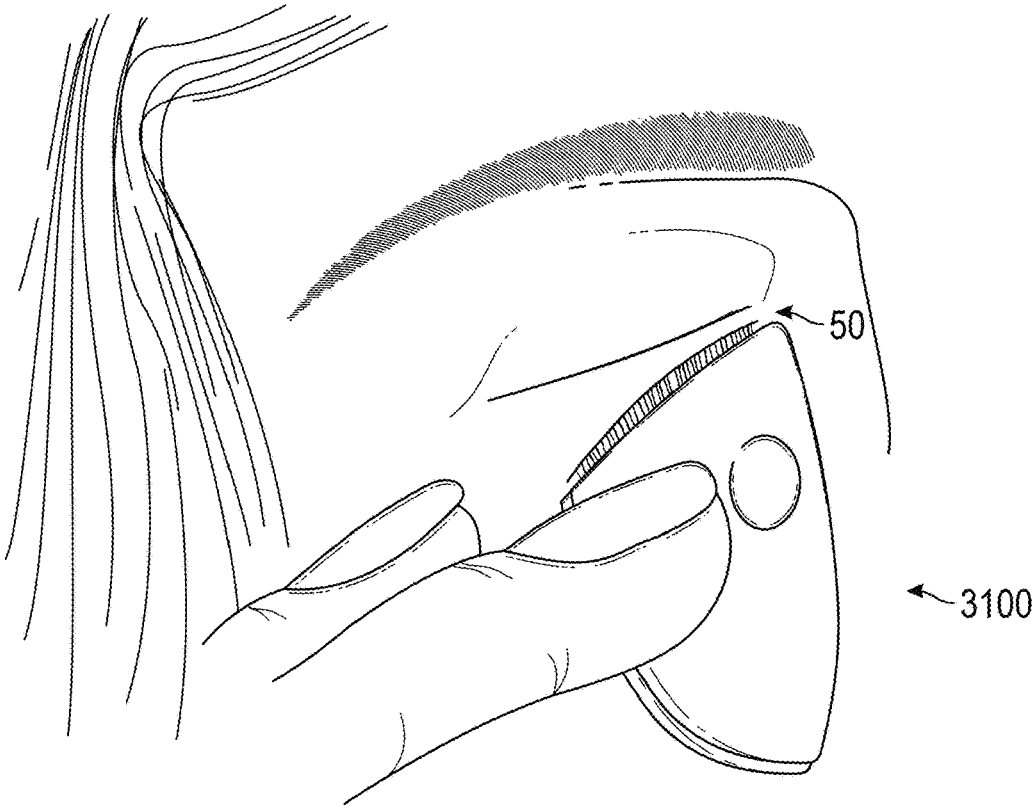
Figure 54C:
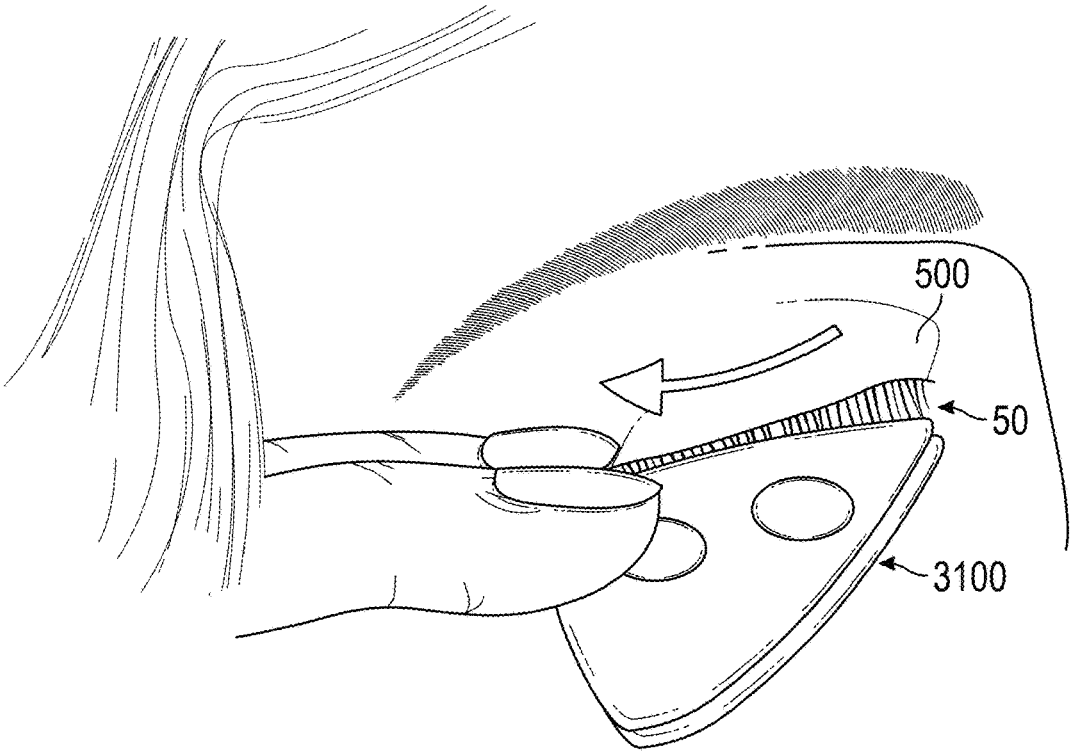
Figure 54D:
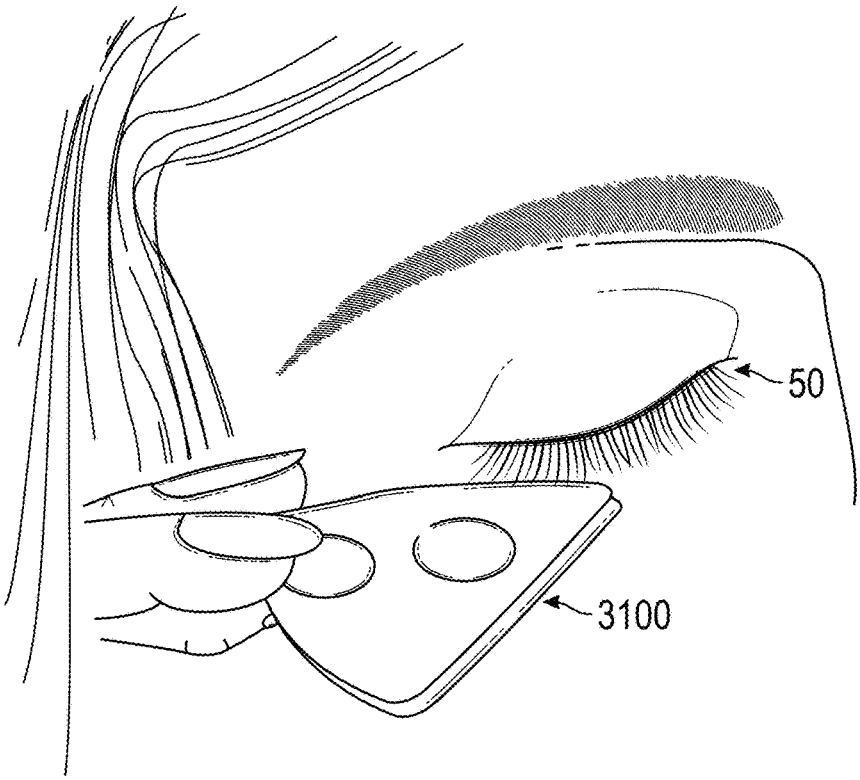

Reference to operating a hingeless applicator will now be described according to some embodiments. Let us assume that initially an inverted or near flat false eyelash has been loaded into applicator 3100 of FIG. 53 in a similar manner as for applicator 200. The inverted or near flat eyelash may be provided using an inverter device of embodiment described herein or by other means. Glue or other adhesive medium is applied to the lash band (either before or once loaded). A glue strip may be pre-applied by the factory. The operator of the applicator 3100, squeezes the clamping members together to bring the members into the closed configuration. Alignment posts 3223 of clamping member 3104 slidably engage holes 3222 of clamping member 3103 maintaining the clamping members in alignment one above the other as the clamping members press together and grip onto the loaded inverted false eyelash with the eyelash band orientated on the exterior of outer side 3204 (similar principle to applicator 200). As shown in FIG. 54A, applicator 3100 is then allowed to default to its neutral position. The operator pressing the clamping members together to maintain them in the closed position brings the applicator into the neutral position by loosing the squeezing pressure sufficiently such that the clamping members open slightly to the neutral position and gently hold the false eyelash 50 in place. Since the alignment posts remain slidably engaged with the holes when the applicator is in the neutral position, the clamping members remain aligned in the neutral position despite the operator having loosed the squeezing pressure. Once once the leading end of the glued eyelash is adhered to a corner of eyelid 500 (see FIG. 54B), eyelash 50 is rolled lengthways by maneuvering applicator 3100 (still in the neural position) on and laterally across eyelid 500 from one corner of the eye to the other (see FIG. 54C). False eyelash 50 flows out of applicator 3100 and is held to eyelid 500 by glue.

In some embodiments, the applicators described herein may be held together by means of a shim action clamp rather than a clip or hinge. The shim clamp is a biasing device that serves a type of spacer mechanism for adjusting the spacing between the clamps. FIGS. 55 to 59 collectively illustrate an applicator 4000 including a shim action clamp for biasing clamping members 4102, 4103 together according to one embodiment. The general shape of clamping members 4102, 4103 is the same as the shape of clamping members of applicator 200. However, clamping members 4102, 4103 can have other shapes, such as those of applicator 3000 or other shapes envisaged herein with reference to other embodiments. Clamping members 4102, 4103 have three outer sides 204 for gripping inverted false eyelash 50 but there may be more or less outer sides 204. A shim action clamp 4200 is provided on the applicator. A shim 4202 is configured to be slidably longitudinal by the operator to sandwich together top clamp member 4103 and bottom clamping member 4102.

Figure 55:
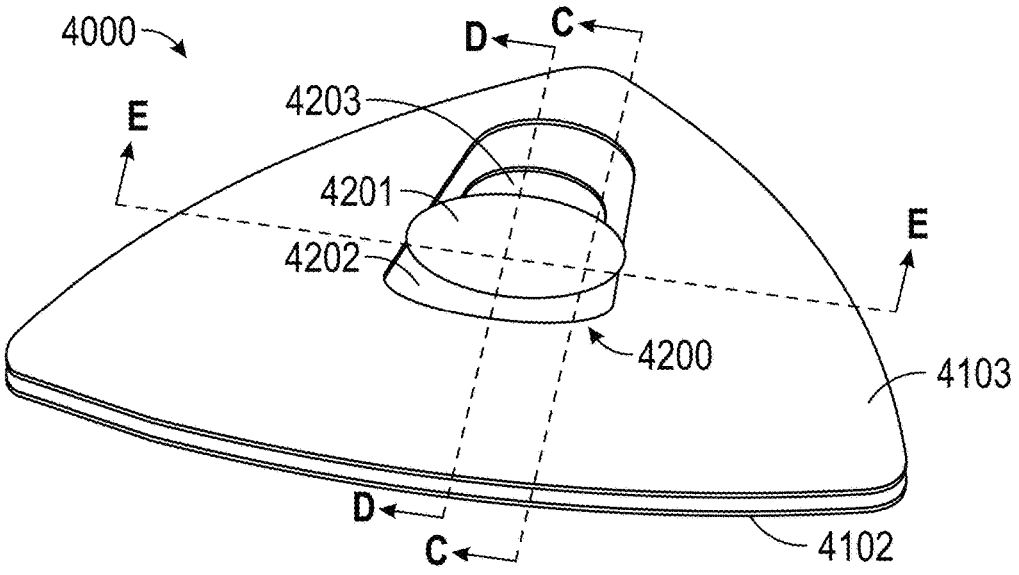
FIGS. 55 illustrates a perspective view of an applicator having a shim clamp biasing the applicator in a neutral/open configuration according to another embodiment.
Figure 57:
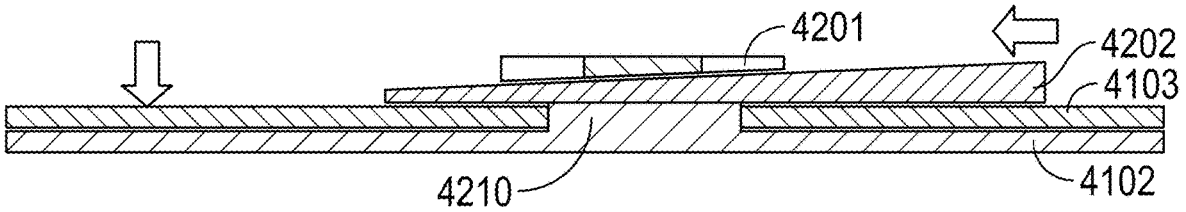
FIG. 57 is a sectional view (section "C-C") taken along an off center axis and in the direction of the arrows for the cutting plane "C-C" shown in FIG. 55.
Figure 58:
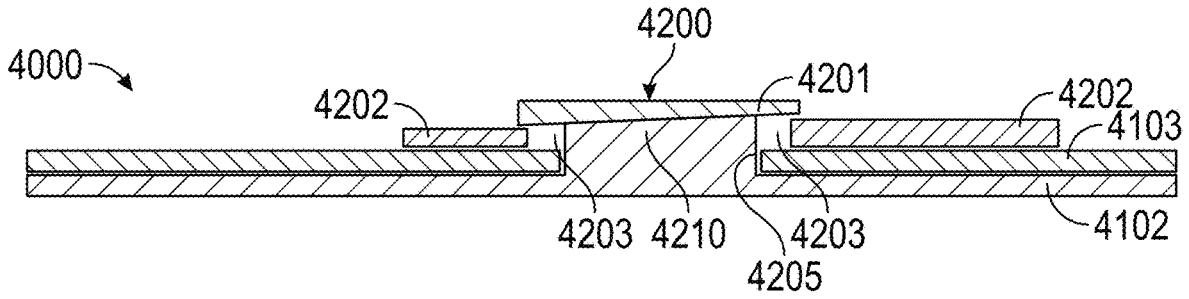
FIG. 58 is a sectional view (section "D-D") taken along the central longitudinal axis of the applicator and in the direction of the arrows for the cutting plane "D-D" shown in FIG. 55.
Figure 59:
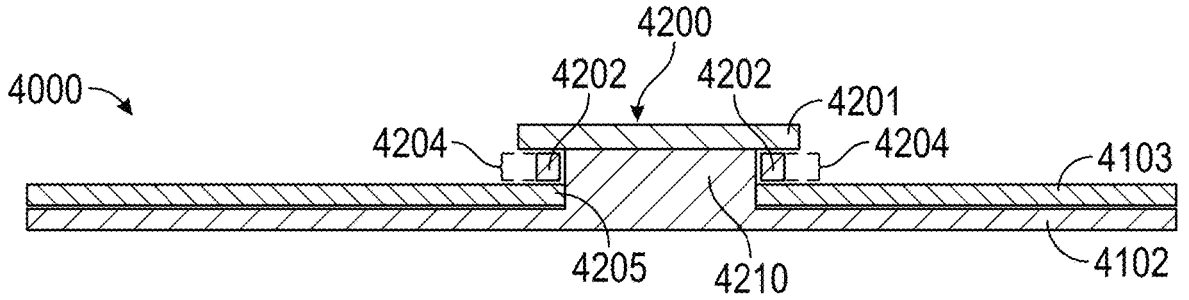
FIG. 59 is a sectional view (section "E-E") taken across the applicator in the direction of the arrows for the cutting plane "E-E" shown in FIG. 55.

FIGS. 55 illustrates a perspective view of applicator 4000 in which shim 4202 has been slide longitudinal rearward to a position in which the shim clamp 4200 is biasing applicator 4000 in a neutral/open configuration. FIG. 57 is a sectional view (section "C-C") taken along an off center axis and in the direction of the arrows for the cutting plane "C-C" shown in FIG. 55. FIG. 58 is a sectional view (section "D-D") taken along the central longitudinal axis of the applicator and in the direction of the arrows for the cutting plane "D-D" shown FIG. 55. FIG. 59 is a sectional view (section "E-E") taken across the applicator in the direction of the arrows for the cutting plane "E-E" shown FIG. 55.

As best shown in FIG. 55 taken in conjunction with FIGS. 57 to 59, the shim action clamp 4200 has a body 4210 integrated with or fixed to the upper side of bottom clamping member 4102. A head 4201 is fixed or integrated with the top of body 4210. Shim 4202 is a generally elongated planar member sandwiched between head 4201 and top clamping member 4103. Body 4210 extends upwardly and protrudes up through and beyond both an opening 4205 formed in top clamping member 4103 and an elongated opening 4203 formed in shim 4202. Head 4210 has a wedge shaped cross section with a generally planer top face and inclined bottom face. The thicker end of head 4201 is oriented towards the front of the applicator and the thinner end to the rear. Inclined head bottom face is spaced above the upper face of top clamping member 4103 by body 4210. Head 4201 has a diameter that is wider than the diameter of body 4210. Consequently, an outer ring shaped portion of head 4201 overlaps the upper face of top clamping member 4103. This head outer portion together with body 4210 and top clamping member 4103 define a ring shaped groove or channel 4204 surrounding body 4210.

Shim opening 4203 is wider than body 4210 but narrower than the width of head 4201. Left and right portions of the shim on either side of opening 4203 are slidably slotted longitudinally in portions of groove 4204 on the left and right sides respectively of body 4210 (see FIG. 59). Also, a shim portion to the rear of the shim opening 4203 may be slidably receivable in a portion of the groove 4204 to the rear of head 4201. Shim 4202 has a wedge shaped longitudinal cross section that compliments the wedge shape of the head. Shim 4202 is orientated with the inclined surface facing upwards and inclining downwardly from the thick rear end of the shim to the thinner front of the shim.

Figure 56:
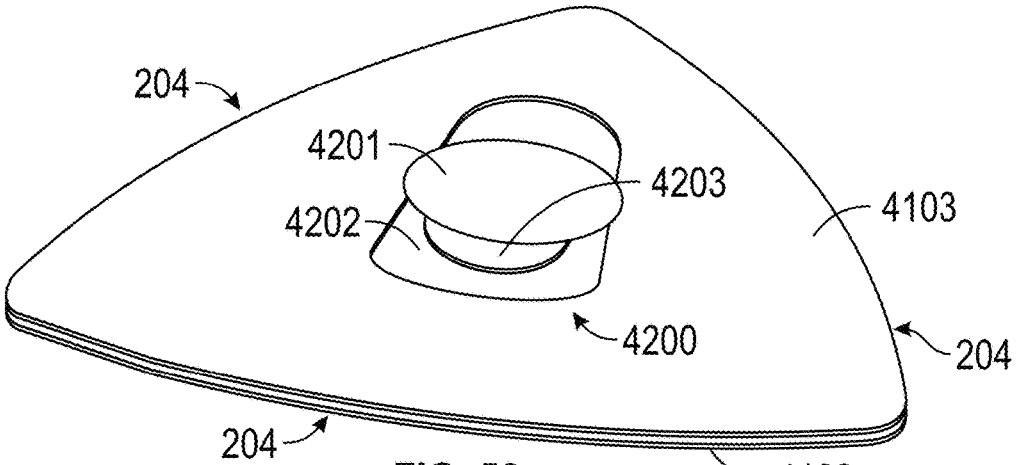
FIGS. 56 illustrates a perspective view of the applicator of FIG. 55 but with the shim clamp biasing the applicator in a closed configuration according to another embodiment.

Pushing shim 4202 longitudinally forward from the position shown in FIGS. 55 and 58-59 causes shim 4202 to wedge longitudinally in left and right portions of groove 4204 either side of body 4210. The portion of the shim to the rear of the opening may also wedge further into the rear portion of groove 4204. Wedging the shim into the groove sandwiches the top and bottom clamping members together into the closed configuration as shown in FIG. 56. The clamping members may be then brought back to the neutral configuration from the closed configuration by withdrawing rearewardly the shim wedge slightly from the groove so as to release some of the biasing force of the shim clamp and thereby loosen the clamping members from one enough to bring them to the neutral configuration. Further withdrawing the shim opens the clamping members more to an open configuration that is sufficient to enable a false eyelash to be loaded into the applicator.

In some embodiments the head need not be wedge shaped and could have a more planar configuration. In some other embodiment, the head may be wedged shaped and the shim may have a more planar rather than wedged shaped configuration. Head and body may have cross-sections that or are of shapes, such as rectangular, square, oval and so on rather than circular.

Different shim clamp configurations are envisaged that serve to bias the clamping members together by means of a shim action in order to adjust the applicator between the open, closed and neutral configurations of the applicator. For example, in one embodiment, body 4210 can be an open topped shell having a longitudinal through cavity through which the shim is slidable longitudinally back and forth between the head and the top clamping member to open and close the clamping members. Furthermore, the shim clamp device of the embodiments may be used in conjunction with applicators having a different size and shape than that shown in FIGS. 55 to FIG. 58. The shim clamp device may be adopted with other types of clamping members of the embodiments described herein.

According to yet further aspects of the present technology, the applicator is provided in a clampless configuration in which a single support member rather than a pair of clamping members is adopted.

Figure 60:
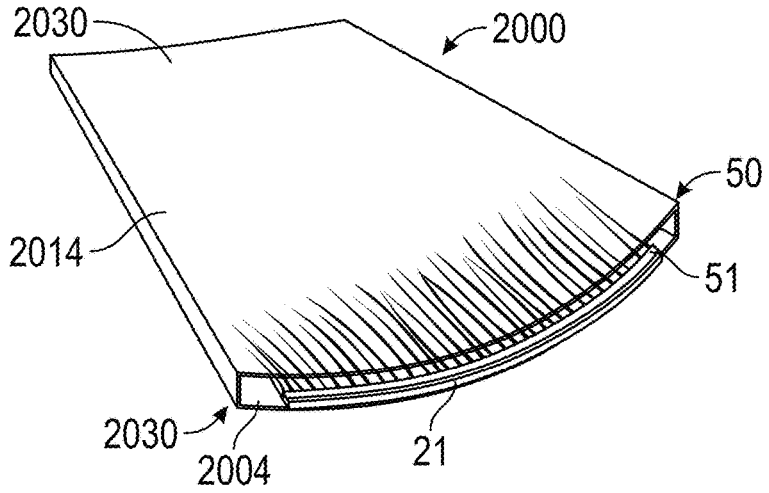
FIG. 60 is a perspective view of an applicator having a inverted false eyelash adhered thereto according to yet another embodiment.
Figure 61:
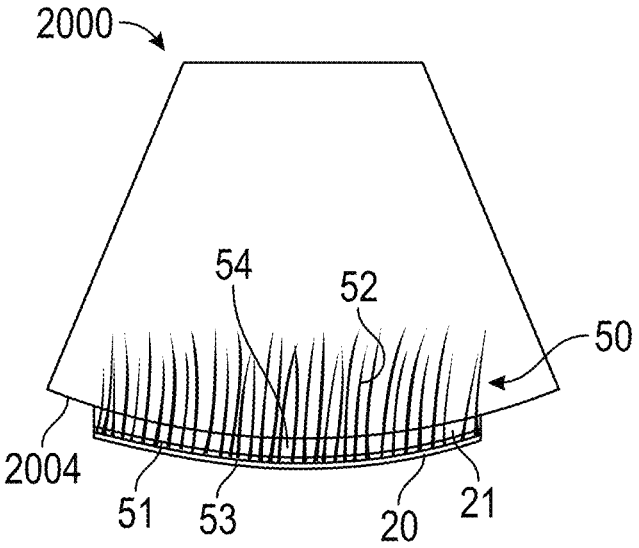
FIG. 61 is a top plan view of the applicator and false eyelash shown in FIG. 60.
Figure 62:
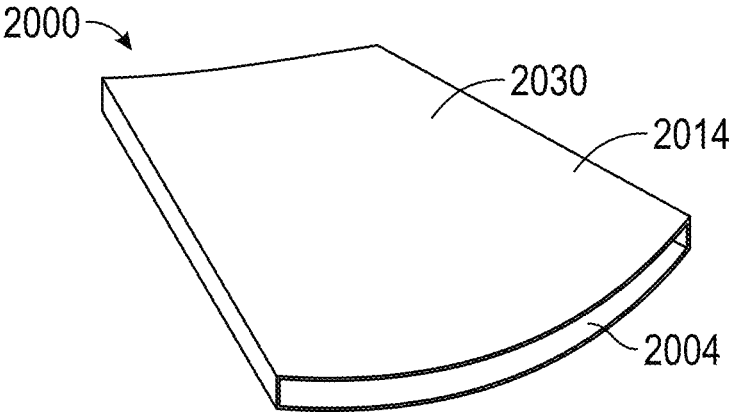
FIG. 62 is a perspective view of the applicator of FIG. 59 without the false eyelash applied thereto.

FIGS. 60 to 62 illustrate such an applicator 2000 according to one embodiment. In some embodiments, the applicator is a disposable applicator. In other embodiments, the applicator is reusable. Applicator 2000 comprises a support member 2014 which is generally planar unitary structure having opposing generally planar outer faces 2030. As for the applicator clamp member of some other described embodiments, the outer faces 2030 may take other profiles, such as but not limited to a clam like convex profile. Support member 2014 has an outer side 2004 extending between outer faces 2030. Outer side 2004 is configured to support, in nested relation, false eyelash 50 generally in the same manner as outer side 204 of applicator 200, 3000 . . . . In the embodiment shown in FIGS. 60 to 62 outer side 2014 extends substantially convexly along the length and extends substantially perpendicularly along the width between outer faces 2030 (generally like the outer surface of part of a cylinder). Other surface profiles along the length and width of outer side 2004 are envisaged that allow false eyelash 50 to be applied to eyelid 500 in the manner described. False eyelash base outerside 54 can be releaseably mounted in a concave shape on support member outer side 2004 using a suitable adhesive 21 and with base inner side 53 facing away from support outer side 2004. The adhesive is chosen and applied in a manner so that the length of the eyelash is releasable from support member 2004 and can be easily rolled onto and laterally across skin of eyelid 500 and off the support member.

In one embodiment, adhesive media 21 applied to adhere false eyelash base outer side 54 to support member outer side 2004 has weaker adhesion characteristics than adhesive media 20 that is applied on eyelash base inner side 53 for subsequently adhering false eyelash 50 to the eyelid. In this manner, as false eyelash 50 is rolled onto the eyelid, stronger adhesive media 20 on eye lash base inner side 53 is able to secure eyelash 50 to the eye lid whereas weaker adhesive media 21 releases the eyelash from the support member outer side. This allows stronger adhesive media 20 on eyelash inner side 53 to effectively pull the rolled lash off support outer side 2004 despite the adhesive media 21 between eyelash base and outer side In some embodiments the stronger and weaker adhesive medias are glue and/or other adhesive medias with compositions that are selected to provide the required stronger and weaker adhesive characteristics (e.g. High tac and low tac glue, respectively). The glue may be but not limited to a glue paste, liquid, and/or thread like glue. In other embodiments, the stronger and weaker adhesive medias may be achieved by applying a greater volume of adhesive to achieve stronger adhesion and by applying lesser volume of adhesive to achieve the weaker adhesion. In yet other embodiments, adhesion is achieved using media other than or in combination with glue such as but not limited felt or tap.

The support member can be made from stiff paper, cardboard, plastic or any other material sufficiently rigid to hold the false eyelash in place and allow the false eyelash to release and attach to the eyelid during application. In some embodiments, the false eyelash can be pre-applied to applicator 2000 and a cover is provided to protect the false eyelash band and any glue or glue strip pre-applied to the inner side of the base that is to be applied to the eyelid. The cover may be cap or a piece of paper or other covering material. The cover piece of paper may be peeled off from the applicator preparatory to applying the false eyelash using the applicator. In yet another embodiment, the applicator could comprises two applicators 2000, one for the left eye and the other for the right eye, that are joined together as one piece to enable the false eyelashes to be applied in a double action one after the other onto respective eyelids.

A method of operating applicator according to one embodiment will now be described. The false eyelash is provided inverted or near flat. The band outer side 54 of the inverted false eyelash is then adhered to the peripheral edge of the applicator outer side 2005 using a weak adhesive 21. This can be performed at the factory or later by the end user. A stronger adhesive 20 is applied to the inner side of the of the false eyelash band (this can be performed after application of the band to the applicator, after the false eyelash has been inverted but before adhering to the applicator, or even before inversion of the false eyelash). In other embodiments, adhesive can be applied to the eyelid. The false eyelash is then rolled laterally across the eyelid by hand manipulation of the support member 2014 in a similar manner to other applicators of embodiments described herein. The eyelash adheres to the eyelid and is released from the support member 2014 during the rolling action.

As already mentioned hereinbefore, in some embodiments, the false eyelash holder for loading the false eyelash into the applicator is pre-configured in the second configuration in which the holder takes the substantially inverted shape or substantially straight shape (flat or near flat shape). This is appropriate for example in disposable applications, other one time use applications and for ease of use by the end user.

Just to be clear, in some embodiments, the false eyelash holder is formed from rigid material in the configuration in which the holder is permanently in the substantially inverted shape or substantially straight shape (flat or near flat shape) (i.e. The support member is not flexible between the first and second configurations and is permanently in the second configuration). In such embodiments, the false eyelash is not inverted by the false eyelash holder but rather inverted before or on application to the false eyelash holder. In such embodiments, the false eyelash holder is similar in shape to any one of the bands shown and described hereinbefore in the second configuration but is made from a rigid material such as but not limited to plastic, metal, wood, cardboard or other material.

Figure 65:
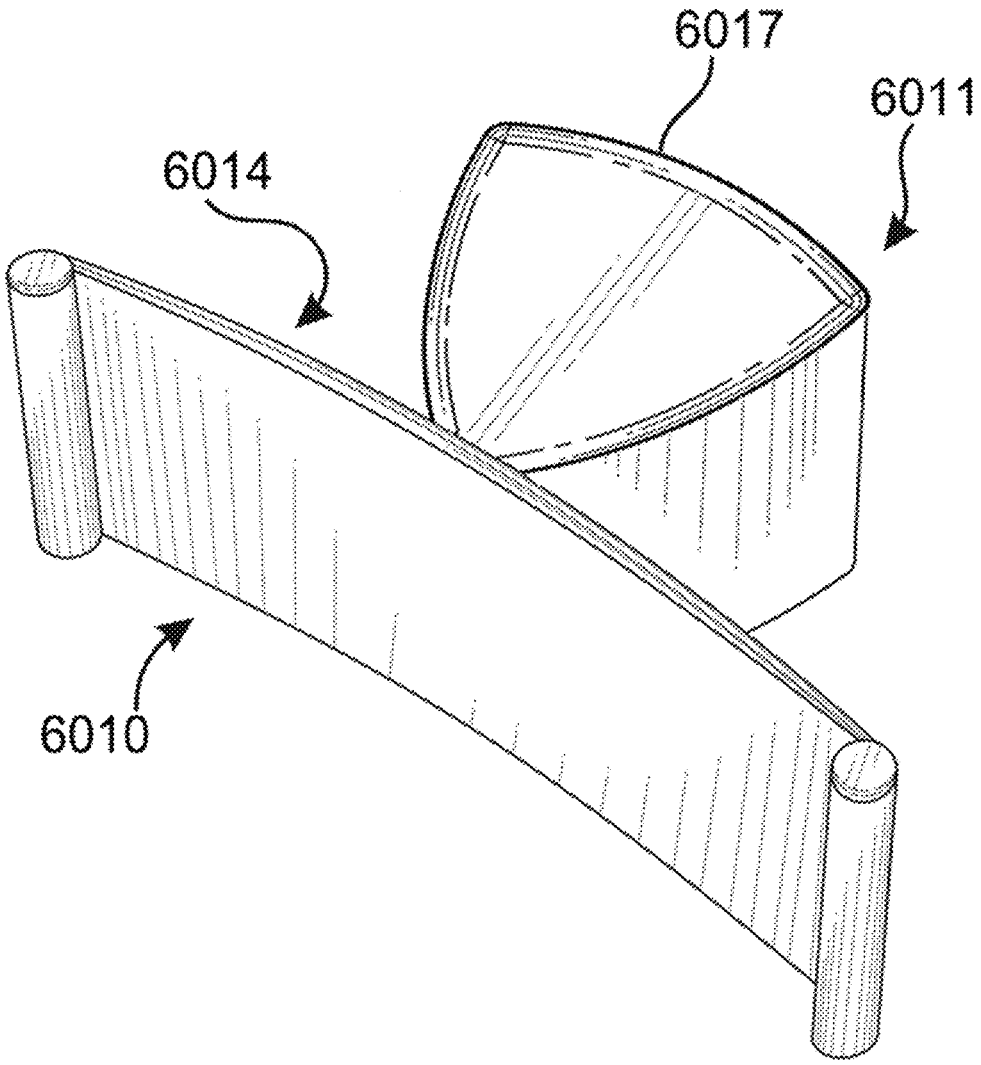
FIG. 65 is a front perspective view of a false eyelash holder for loading a falsh eyelash into an applicator according to another embodiment.
Figure 66:
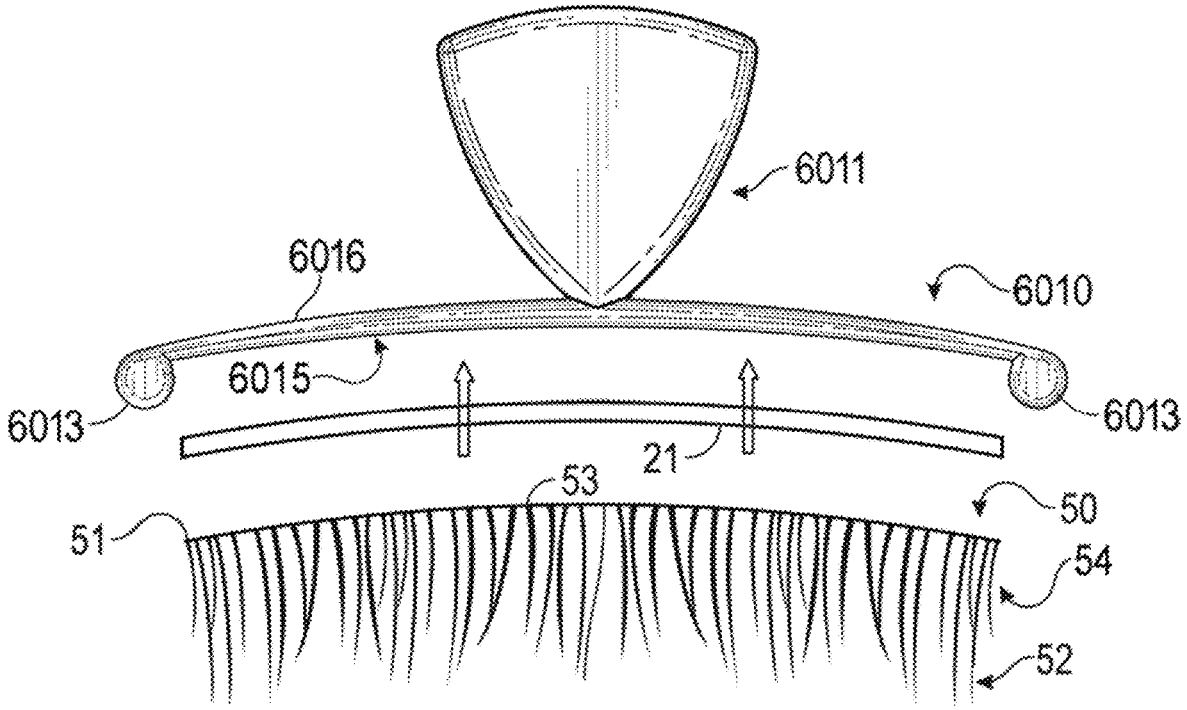
FIG. 66 is a plan view of the false eyelash holder of FIG. 65 and showing an inverted false eyelash being applied thereon according to an embodiment.

By way of example, FIGS. 65 & 66 show perspective and top plan views respectively of false eyelash holder 6010 that is made from rigid material according to one embodiment. False eyelash holder 6010 has a support member 6014. In this embodiment, support member 6014 is a strip or band of material that is similar in shape to the inverted bands described hereinbefore with reference to other embodiments of false eyelash holders. False eyelash holder 6010 includes a finger grip or handle 6011. Outer side 6015 of support member 6014 has the substantially inverted shape for supporting the false eyelash. In other embodiments, outer side 6015 is substantially straight shape (flat or near flat shape) for supporting falsh eyelash 50.

In the embodiment of FIG. 65, finger grip 6011 is a uniform post having a generally triangular cross section. A corner edge of the post is joined to an inner side of support member 6014 and extends between top and bottom sides thereof. Grip 6011 has planar top and bottom ends located about top and bottom sides, respectively, of support member 6014 whereas each of the three side faces of grip 6011 is slightly convex in shape. Finger grip 6011 enables the false eyelash holder to be easily griped and manipulated with fingers without the need of a separate holder device.

Finger grip or handle 6011 can be any shape and orientation relative to the support member that enables support member outerside 6015 to be held and manipulated by fingers of a user. For example, in some embodiments, finger grip can have a circular cross section rather than a triangular cross section. Furthermore, finger grip 6011 can be attached or integrated with the support member at other locations than those shown in the drawing. In other embodiments, false eyelash holder 6010 can include a shorter triangular cross sectioned finger grip 6011 and an alignment post 6012 extending therebelow from the bottom face of finger grip 6011 down to the bottom side of support member 6014 as for example shown in FIG. 67. Alignment post 6012 is shaped to cooperate with a post receiving hole of any of the holder devices described herein (see for devices 100 and 1000 and portable holder device 300 described herein for examples of suitable holder devices and their operation for holding and supporting false eyelash holder support member 6014). In this way, false eyelash holder 6011 can be easily located and secured in the post receiving member of a holder device and manipulated by the holder device.

As best shown in FIG. 66, which is a top view of false eyelash holder 6010 and a false eyelash 50 being arranged ready for attaching to holder 6010 according to one embodiment. Attaching of the false eye lash 50 to eyelash holder 10 may be for example performed by the false eyelash manufacturer and/or by people who want to reuse their used false eyelashes. Note false eyelash 50 is inverted before or on applying to support member 6014.

As already mentioned hereinbefore, false eyelash 50 has a base 51 and false lashes 52, which extend outwardly away from the base. False eyelash base 51 has an inner side 53 for adhering to an eyelid and outer side 54 from which false lashes 52 extend away from base 51. In some embodiments, false eyelash 50 is a conventional type crescent shaped false eyelash, which in isolation, generally assumes or defaults to a convex shape in which base outer side 54 and base inner side 53 are generally convex and concave shaped, respectively.

In alternative embodiments, the false eyelash, can, in isolation, assume other default shapes.

Figure 68:
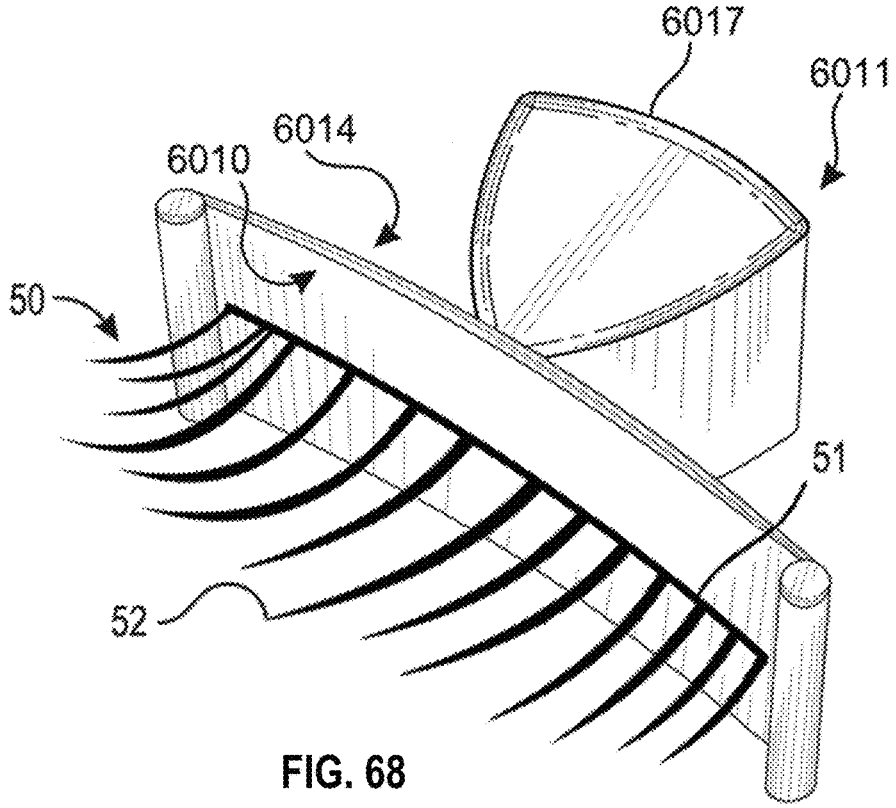
FIG. 68 is a perspective view of the false eyelash holder of FIG. 66 releaseably supporting the false eyelash applied thereto according to one embodiment.

False eyelash 50 is supportable in a substantially concave shape on support member 14. By way of example, false eyelash 50 being applied to and releaseably supported on support member 6014 is shown in FIGS. 66 and 68, respectively, according to one embodiment. False eyelash 50 is releaseably supported on support member outer side 6015 and orientated such that base inner side 53 faces support outer side 6015 and base outer side 54 faces outwardly away from the support outer side 6015. In this manner, the false eyelash base outer side 54 and base inner side 53 are supported in a substantially concave shape and convex shape, respectively, on and in nested relation, with support member outer side 6015. False eyelash 50 is releaseably supported by means of adhesive layer 21 which layer may be applied on support member 6014 directly, or the false eyelash directly or both the support member and false eyelash prior to application of the false eyelash to the support member. In other embodiments, the support member outer side is substantially straight (flat or near flat) and the false eyelash are supported in a substantially straight shape.

Figure 67:
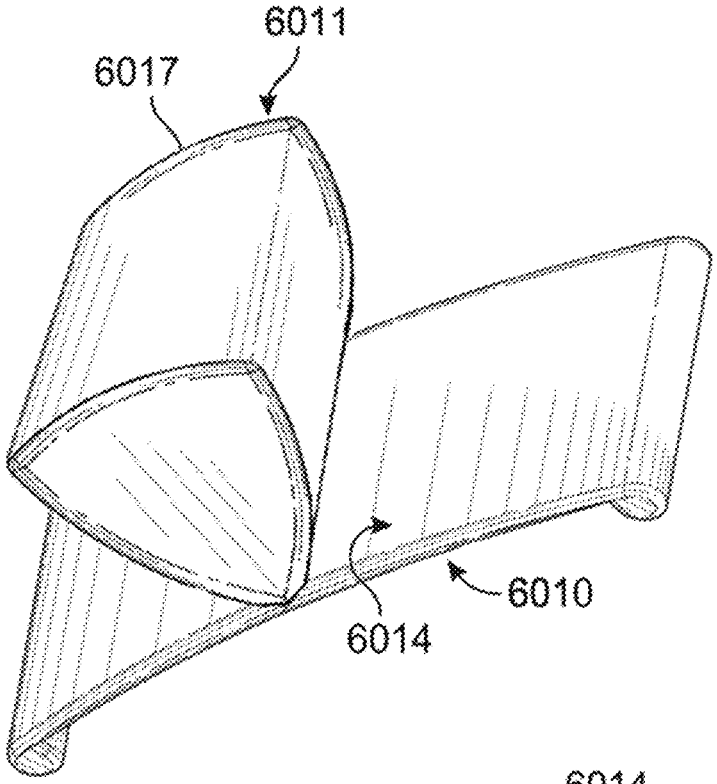
FIG. 67 is a rear perspective view taken from below of a false eyelash holder according to yet another embodiment.

In the embodiments shown in FIGS. 65 to 67, support member 6014 is made from a strip or band of rigid material such as but not limited to plastic, metal, natural and/or synthetic material (cardboard, wood etc.).

Furthermore, in other embodiments, support member 6014 need not take the form of a strip or band but may be any shaped body of material (with or without finger grip 6011) but with the outer side 6015 being shaped to support false eyelash 50 in the substantially concave or substantially straight shape. In FIG. 65, outer side 6015 has a substantially concave curvature lengthwise that compliments the lengthwise convex curvature of the applicator outer side (see for example Applicator 200 and side 204). In other embodiments in which outerside 6015 is near flat or flat, the curvature of the applicator may also compliment the near flat or flat curvature lengthwise. In yet other embodiments, outerside 6015 may not have a curvature lengthwise that compliments the lengthwise curvature of the applicator outer side but is of curvature or profile that allows the false eyelash applied to outerside 6015 to be loaded into the Applicator (see for example Applicator 200).

As with other embodiments of the false eyelash holder, the radius of curvature of the base of the false eyelash is a radius that generally corresponds to a radius of curvature of the outer side of an Applicator according to an aspect of the present technology (see for example embodiments of Applicators 200 etc. described herein). In some embodiments, any radius of curvature that allows the false eyelash, loaded in the Applicator, to be rollable by the Applicator lengthwise laterally over the eyelid and off the Applicator is envisaged.

In some embodiments, the shape of the false eyelash may not need to be a fully concave shape but may still allow the false eyelash, when applied to support member 6014, to be rollable by the Applicator onto the eyelid. In other embodiments of support member 6014, false eyelash 50 is supportable in a substantially straight or flat shape rather than concave shape on support member 6014. In yet further embodiments, the false eyelash 50 remains supported in a convex shape but has a radius of curvature that is very, very large compared to the radius of curvature of the eyelid.

In one embodiment, opposing distal ends 6013 of support member 6014, are in the form of two cylindrical spacers, or other types of spacers, which extend from top to bottom of the flex band to align inverted false eyelash 50 on, and offset away from, applicator outer side 204, and keep inverted false eyelash 50 from being gripped too close to the eyelash band 51 (in the same manner as the flex-band of FIG. 26). In one embodiment, the spacers are configured to space the aligned band 51 about 0.25-5 mm from the applicator outer side edge. In other embodiments, other spacing between aligned band 51 and applicator outer side edge may be adopted which achieves similar applicator functionality as described herein. If eyelash band 51 is too close or flush with applicator outer side edge, eyelash glue could get on both eyelash band 51 and the applicator's edge, effectively gluing false eyelash 50 to applicator 200. Additionally, offsetting false eyelash band 51 away from outer side 204, gives the user a clear view of the false lash's edge and thus where it will go on eyelid 500. In other embodiments, the spacers are omitted from the false eyelash holder support member.

False eyelash holder 6010 advantageous in that an inverted false eyelash carried thereon can be easily loaded in the applicator.

In some aspects, a false eyelash applicator system or other system is provided that comprises any combination of two or more of the embodiments of components described herein such as any two or more of the following: false eyelash holder, inverter device, inverter-loader, portable holder, applicator, applicator clip, applicator shim clamp, clamping members, clamping member alignment post(s)/hole(s), applicator space mechanim, applicator hinge, false eyelash, false eyelash holder tray and/or box, the adhesive mediums. In some embodiments of the system, one or more of the aforementioned components are disposable.

While preferred embodiments of the present invention have been described and illustrated in detail, it is to be understood that many modifications can be made to the embodiments, and features can be interchanged between embodiments, without departing from the spirit of the invention.

What is claimed is:

1. A false eyelash applicator comprising:

a first clamp member; and a second clamp member;

wherein said first clamp member has a first outer side;

wherein said second clamp member has a second outer side;

wherein at least one of said first outer side and said second outer side has a substantially convex curved shape in a horizontal plane; and a handle portion, integrated with or extending from, said first clamp member and said second clamp member, for manipulating said first clamp member and said second clamp member;

wherein said first clamp member and said second clamp member are operably coupled together to adjust said first clamp member and said second clamp member between an open configuration, a neutral configuration and a substantially closed configuration;

wherein in said open configuration, said first clamp member and said second clamp member are open and said first outer side is vertically spaced apart from said second outer side to allow a plurality of false lashes distributed along an eyelash band of an inverted false eyelash to be placed between said first outer side and said second outer side;

wherein in said closed configuration; said first clamp member and said second clamp member are closed together to allow the false eyelash to be held inverted by the first clamp member and the second clamp member, said first outer side and said second outer side being configured to tightly grip the plurality of false lashes with the eyelash band held on the exterior side of said first outer side and said second outer side such that the false eyelashes extend away from the eyelash band and into said applicator between said first clamp member and said second clamp member;

wherein said first clamp member includes a lash receiving groove extending convexly in said horizontal plane along said first outer side and wherein said second clamp member includes a corresponding curved portion, said lash receiving groove and corresponding curved portion being nestable with one another and being profiled such that, when said first clamp member and second clamp member are in the closed configuration gripping said plurality of false lashes, said plurality of false lashes substantially maintain their naturally curled shape; and wherein in said neutral configuration, said first clamp member outer side and said second member outer side are held substantially parallel in a vertical plane and spaced apart vertically by an air gap extending horizontally lengthwise; said first clamp member and said second clamp member being configured to loosely hold said plurality of false lashes in said air gap with said eyelash band remaining disposed on the exterior side of first outer side and said second outer side to thereby maintain said false eyelash in a substantially inverted shape and ready for rolling lengthwise on to an eyelid.

2. The false eyelash applicator of claim 1, wherein in said closed configuration said first clamp member and second clamp member are configured to hold said eyelash band of said inverted false eyelash off set away from the exterior side of said first outer side and said second outer side.

3. The false eyelash applicator of claim 1, further comprising a spacer mechanism which is configured to be operable to cause said first clamp member and second clamp member to space apart from the substantially closed configuration to the neutral configuration by a predetermined amounted and form a gap therebetween.

4. The false eyelash applicator of claim 3, wherein said spacer mechanism comprises a hinge and a latch mechanism which are operable to linearly space apart said first clamp member and second clamp member from one another to form said gap.

5. The applicator of claim 3, where said spacer mechanism comprises a biasing device, said biasing device being configured to bias said first clamp member and said second clamp member between said substantially open, neutral and closed configurations.

6. The applicator of claim 5, wherein said biasing device comprises a shim clamp integrated with said applicator.

7. The applicator of claim 5, wherein said biasing device comprises a clip separate from or integrated with said applicator.

8. The applicator of claim 3, wherein said spacer mechanism is configured to orientate the clamp members in parallel in the neutral configuration.

9. The applicator of claim 1, wherein said each one of said first clamp member and said second clamp member comprises a unitary structure.

10. The applicator of claim 1, further comprising:

at least one alignment post formed on one of said first clamp member and said second clamp member; and at least one associated hole formed on the other one of said first clamp member and said second clamp member, said alignment post(s) and associated hole(s) being arranged on said clamp member(s) to slidable engage one another and align said first clamp member and said second clamp member one above the other as said first clamp member and second clamp member are pressed together.

11. A false eyelash applicator comprising:

a first clamp member; and a second clamp member;

wherein said first clamp member has a first outer side;

wherein said second clamp member has a second outer side;

wherein at least one of said first outer side and said second outer side has a substantially convex curved shape in a horizontal plane;

a handle portion, integrated with or extending from, said first clamp member and said second clamp member, for manipulating said first clamp member and said second clamp member;

at least one alignment post formed on one of said first clamp member and said second clamp member; and at least one associated hole formed on the other one of said first clamp member and said second clamp member, said alignment post(s) and associated hole(s) being arranged on said clamp member(s) to slidable engage one another and align said first clamp member and said second clamp member one above the other as said first clamp member and second clamp member are pressed together;

wherein said first clamp member and said second clamp member are operably coupled together to adjust said first clamp member and said second clamp member between an open configuration, a neutral configuration and a substantially closed configuration;

wherein in said open configuration, said first clamp member and said second clamp member are open and said first outer side is vertically spaced apart from said second outer side to allow a plurality of false lashes distributed along an eyelash band of an inverted false eyelash to be placed between said first outer side and said second outer side;

wherein in said closed configuration; said first clamp member and said second clamp member are closed together to allow the false eyelash to be held inverted by the first clamp member and the second clamp member, said first outer side and said second outer side being configured to tightly grip the plurality of false lashes with the eyelash band held on the exterior side of said first outer side and said second outer side such that the false eyelashes extend away from the eyelash band and into said applicator between said first clamp member and said second clamp member; and wherein in said neutral configuration, said first clamp member outer side and said second member outer side are held substantially parallel in a vertical plane and spaced apart vertically by an air gap extending horizontally lengthwise;

said first clamp member and said second clamp member being configured to loosely hold said plurality of false lashes in said air gap with said eyelash band remaining disposed on the exterior side of first outer side and said second outer side to thereby maintain said false eyelash in a substantially inverted shape and ready for rolling lengthwise on to an eyelid.

12. The false eyelash applicator of claim 11, further comprising a spacer mechanism which is configured to be operable to cause said first clamp member and second clamp member to space apart from the substantially closed configuration to the neutral configuration by a predetermined amounted and form a gap therebetween.

13. The false eyelash applicator of claim 12, wherein said spacer mechanism comprises a hinge and a latch mechanism which are operable to linearly space apart said first clamp member and second clamp member from one another to form said gap.

14. The applicator of claim 12, where said spacer mechanism comprises a biasing device, said biasing device being configured to bias said first clamp member and said second clamp member between said substantially open, neutral and closed configurations.

15. The applicator of claim 14, wherein said biasing device comprises a shim clamp integrated with said applicator.

16. The applicator of claim 14, wherein said biasing device comprises a clip separate from or integrated with said applicator.

17. The applicator of claim 11, wherein said each one of said first clamp member and said second clamp member comprises a unitary structure.

18. A false eyelash applicator comprising:

a first clamp member; and a second clamp member;

wherein said first clamp member has a first outer side;

wherein said second clamp member has a second outer side;

wherein at least one of said first outer side and said second outer side has a substantially convex curved shape in a horizontal plane;

a handle portion, integrated with or extending from, said first clamp member and said second clamp member, for manipulating said first clamp member and said second clamp member; and a spacer mechanism comprising a hinge and a latch;

wherein said first clamp member and said second clamp member are operably coupled together to adjust said first clamp member and said second clamp member between an open configuration, a neutral configuration and a substantially closed configuration;

wherein in said open configuration, said first clamp member and said second clamp member are open and said first outer side is vertically spaced apart from said second outer side to allow a plurality of false lashes distributed along an eyelash band of an inverted false eyelash to be placed between said first outer side and said second outer side;

wherein in said closed configuration; said first clamp member and said second clamp member are closed together to allow the false eyelash to be held inverted by the first clamp member and the second clamp member, said first outer side and said second outer side being configured to tightly grip the plurality of false lashes with the eyelash band held on the exterior side of said first outer side and said second outer side such that the false eyelashes extend away from the eyelash band and into said applicator between said first clamp member and said second clamp member; and wherein in said neutral configuration, said first clamp member outer side and said second member outer side are held substantially parallel in a vertical plane and spaced apart vertically by an air gap extending horizontally lengthwise; said first clamp member and said second clamp member being configured to loosely hold said plurality of false lashes in said air gap with said eyelash band remaining disposed on the exterior side of first outer side and said second outer side to thereby maintain said false eyelash in a substantially inverted shape and ready for rolling lengthwise on to an eyelid; and wherein said spacer mechanism is configured to be operable to linearly space apart said first clamp member and second clamp member from the substantially closed configuration to the neutral configuration by a predetermined amounted and form said air gap.

19. The false eyelash applicator of claim 18, wherein in said closed configuration said first clamp member and second clamp member are configured to hold said eyelash band of said inverted false eyelash off set away from the exterior side of said first outer side and said second outer side.

20. The applicator of claim 18, wherein said spacer mechanism is configured to orientate the clamp members in parallel in the neutral configuration.

21. The applicator of claim 18, wherein said each one of said first clamp member and said second clamp member comprises a unitary structure.

* * * * *